US010888987B2

(12) United States Patent
King, Jr.

(10) Patent No.: US 10,888,987 B2
(45) Date of Patent: Jan. 12, 2021

(54) POWER TOOL SKI SYSTEM AND METHOD

(71) Applicant: Skitter & Squirt Adventures, LLC, Missoula, MT (US)

(72) Inventor: Jack M. King, Jr., Phoenix, AZ (US)

(73) Assignee: Skitter & Squirt Adventures, LLC, Missoula, MT (US)

( * ) Notice: Subject to any disclaimer, the term of this patent is extended or adjusted under 35 U.S.C. 154(b) by 572 days.

(21) Appl. No.: 15/587,227

(22) Filed: May 4, 2017

(65) Prior Publication Data

US 2017/0232600 A1 Aug. 17, 2017

(51) Int. Cl.

| | |
|---|---|
| ***B25D 17/28*** | (2006.01) |
| ***B25H 1/00*** | (2006.01) |
| ***B25D 11/00*** | (2006.01) |

(52) U.S. Cl.

CPC ..... *B25D 17/28* (2013.01); *B25D 11/00* (2013.01); *B25H 1/0021* (2013.01); *B25H 1/0042* (2013.01); *B25D 2250/041* (2013.01)

(58) Field of Classification Search

CPC ..... B25D 1/16; B25D 17/00; B25D 17/28; B25D 11/00; B25D 2250/041; B25H 1/0021; B25H 1/0035; B25H 1/0042; B25H 1/0078; H01M 2/10

USPC ..... 173/9, 31, 32, 90; 429/163

See application file for complete search history.

(56) References Cited

U.S. PATENT DOCUMENTS

| | | | | |
|---|---|---|---|---|
| 3,712,390 | A | 1/1973 | Berg | |
| 4,770,254 | A | 9/1988 | Kominami | |
| 6,666,282 | B2 | 12/2003 | Merrick | |
| 6,669,206 | B2 | 12/2003 | Hanke | |
| 6,835,030 | B2 | 12/2004 | Pozgay | |
| 6,910,578 | B2 | 6/2005 | Stern | |
| 7,168,504 | B2 | 1/2007 | Hetcher | |
| 7,182,150 | B2 * | 2/2007 | Grossman | B23Q 37/00 173/198 |
| 7,357,526 | B2 * | 4/2008 | Zeiler | B25B 23/18 362/109 |
| 8,210,545 | B2 | 7/2012 | Hild | |
| 8,215,962 | B1 | 7/2012 | Machado | |
| 8,343,654 | B2 * | 1/2013 | Churchill | H02J 7/0045 429/178 |
| 8,375,541 | B1 * | 2/2013 | Beachy | B25F 3/00 29/26 A |
| 8,636,081 | B2 | 1/2014 | Ludy | |

(Continued)

FOREIGN PATENT DOCUMENTS

| | | |
|---|---|---|
| EP | 1369210 | 12/2003 |

*Primary Examiner* — Hemant Dasai
*Assistant Examiner* — Jacob A Smith
(74) *Attorney, Agent, or Firm* — Lisa Foundation Patent Law Clinic at Arizona State University

(57) ABSTRACT

A power tool accessory for elevating the base of a power tool from off a work surface and a method of use. The accessory or ski comprises a bridge, a first side wall coupled to the bridge, and a second side wall coupled to the bridge opposite the first side wall. The bridge, the first side wall, and the second side wall form an upper surface and an opening through which a power cord may pass. The upper surface is configured to receive a base of a power tool. Because the ski elevated the power tool from off of a work surface, dust, debris, and grit is not brought into the intake of the power tool, the power cord is not kinked, and the base of the power tool is not worn down on the work surface.

20 Claims, 25 Drawing Sheets

(56) References Cited

U.S. PATENT DOCUMENTS

| | | | | |
|---|---|---|---|---|
| 8,984,711 | B2 * | 3/2015 | Ota | H02J 7/0021 15/339 |
| 10,224,524 | B2 * | 3/2019 | Miller | H01M 2/1022 |
| 2003/0164242 | A1 | 9/2003 | Richter | |
| 2003/0223836 | A1 * | 12/2003 | Pozgay | B23Q 11/0046 409/182 |
| 2005/0058890 | A1 * | 3/2005 | Brazell | H01M 2/1094 429/99 |
| 2008/0032190 | A1 * | 2/2008 | Furuta | B25F 5/02 429/163 |
| 2010/0000067 | A1 * | 1/2010 | Turner | B25F 5/02 29/428 |
| 2011/0005793 | A1 * | 1/2011 | Hanawa | B25F 5/02 173/217 |
| 2011/0214547 | A1 * | 9/2011 | Inayoshi | B25F 5/02 83/508.2 |
| 2012/0206591 | A1 * | 8/2012 | Selby | A61B 1/00105 348/82 |
| 2014/0273771 | A1 | 9/2014 | Kuehne | |
| 2015/0372633 | A1 * | 12/2015 | Machida | B23D 59/001 318/14 |

* cited by examiner

POWER TOOL SKI SYSTEM AND METHOD

BACKGROUND

1. Technical Field

Aspects of this document relate generally to systems and methods for elevating a power tool from off a work surface.

2. Description of Related Art

Power tools, especially chipping hammers are often used in circumstances that are not optimal for long term performance. For example, chipping hammers used for removing tile create grit and dust that can be brought into the motor and other components of the tool through the intake. Especially the grit and debris can remove hours of life from the tool and requires expensive repairs as the tool's components must be replaced and overhauled.

Tools can also be heavy, especially after sustained use by a user while bearing the weight of the tool. Many of these power tools also vibrate and are uncomfortable to bear while using. This can cause fatigue and health issues.

So as to reduce the complexity and length of the Detailed Specification, and to fully establish the state of the art in certain areas of technology, Applicant(s) herein expressly incorporate(s) by reference all of the following materials identified in each numbered paragraph below.

U.S. Pat. No. 8,215,962 discloses a waterproof, swivel feature on power cords suitable within a construction setting. The device allows rotational movement between the plug and socket components such that cord twisting and buckling is eliminated and fatigue on an operator is reduced.

U.S. Pat. No. 3,712,390 discloses a high energy impact operated tool assembly for powering interchangeable terminal devices. The assembly includes an encasement and a member mounted for sliding movement.

U.S. Pat. No. 6,910,578 discloses an accessory holder for releasably storing tool implements on a portable hand power tool.

U.S. Pat. No. 7,182,150 discloses an accessory system having a releasable motor and battery pack.

U.S. Pat. No. 7,357,526 discloses a power tool accessory combination in which a battery back or battery assembly can be electrically connected to an unused tool terminal that is otherwise engaged by a battery pack.

U.S. Pat. No. 6,835,030 discloses a power tool accessory system having a first accessory with a first connector for attaching the accessory of the power tool and a second connector for attaching a second accessory to the first accessory. A proximal end of each of the arms rotatably connects to a weight, while a distal end of each of the arms is adapted to rotatably connect to the driver tool. The weight is located on an opposite side of the support member from the driver tool when the driver tool is attached.

U.S. Pat. No. 8,210,545 discloses a tool holder for a hand-guided drilling device having a receiving sleeve designed as a single piece to be drivable in a rotating manner for a shank part of an insertion tool.

U.S. Pat. No. 4,770,254 discloses a rotary hammer with a hammer body and an electric motor section. the hammer body has a tool holding section in which the tool holding member for concomitantly rotatably holding the tool is rotatably supported by a bracket removably connected to the frame. The sections are arranged such that they can be assembled and disassembled individually as separate component units.

U.S. Pat. No. 6,666,282 discloses an impact tool carriage system that supports an impact or driver too. The carriage system has a support member that extends upwardly from a base platform. Support arms are rotatably connected to the support member at medial portion of the arms at different elevations above the support member.

U.S. Pat. No. 6,669,206 discloses a tool holder for a rotary hammer with a locking element, a supporting ring axially movable between a position supporting the locking element in the locked position and a second position defining a first release position of the locking element.

U.S. Pat. No. 8,636,081 discloses a rotary hammer having a motor, a spindle, a piston, a striker, and an anvil. The rotary hammer also includes a retainer received within the spindle for selectively securing the striker.

U.S. Pat. No. 7,168,504 discloses a rotary hammer and a power tool. The rotary hammer is operable in an idle mode and a hammer mode and comprises a housing and a barrel positioned in the housing and having a forward portion. A ram is positioned within the barrel and is movable relative to the barrel between hammering positions and an idle position.

US Patent Application 2014/0273771 discloses a removable accessory for power tools which is changeable without requiring extra tools.

US Patent Application 2003/0164242 discloses a power tool accessory system having a displacement and support device with a power cylinder provided at its opposite ends, respectively, with an assembly element for connecting the power cylinder to the power tool and a support leg; a control valve for controlling operation of the power cylinder; and a manually rotationally adjustable actuation member for actuating the control valve, with the actuation member being formed as a handle extending transverse to an axis (A) of the power cylinder Applicant(s) believe(s) that the material incorporated above is "non-essential" in accordance with 37 CFR 1.57, because it is referred to for purposes of indicating the background of the invention or illustrating the state of the art. However, if the Examiner believes that any of the above-incorporated material constitutes "essential material" within the meaning of 37 CFR 1.57(c)(1)-(3), Applicant(s) will amend the specification to expressly recite the essential material that is incorporated by reference as allowed by the applicable rules.

SUMMARY

The present disclosure provides among other things a power tool ski accessory. The ski system includes an upper surface configured to detachably couple to the base of a power tool. The upper surface includes two side walls and a bridge, forming an opening through with a power cord may pass. The ski elevates the power tool from a working surface to prevent uptake of dust, grit, and dirt which leads to the breakdown of motor components and also prevents the wear and tear of the power cord and base of the power tool from movement along the working surfaces and from resting the power tool on the working surface.

In one embodiment a power tool ski comprises a bridge, a first side wall coupled to a first edge of the bridge, a second side wall coupled to a second edge of the bridge opposite the first edge of the bridge; wherein the bridge, the first side wall, and the second side wall comprise an upper surface configured to receive a base of a power tool, wherein the bridge, the first side wall, and the second side wall form an opening configured to permit a power cord to pass therethrough, and wherein the first side wall and the second side wall are configured to elevate the base of the power tool from a work surface when coupled to the base of a power tool and configured to prevent contact between the base of the power tool and the work surface when coupled to the base of the power tool; and a securing mechanism coupled to the upper surface and configured to detachably couple to the base of a power tool.

In some embodiments the first side wall and the second side wall may be substantially parallel. In other embodiments the first side wall and the second side wall may be non-parallel. A front edge of the bridge may be narrower than a back edge of the bridge, such that the first side wall and a second side wall are non-parallel.

In other embodiments the upper surface may further comprise a lip configured to receive a notch of the base of the power tool, wherein the lip is located distal from the securing mechanism and extends from the first side wall to the second side wall. The securing mechanism may comprise a channel configured to correspond to a second channel of a key and configured to receive a securing pin.

In some embodiments the first side wall and the second side wall each may comprise a first side edge, a second side edge substantially parallel to the first side edge, a third side edge extending from the first side edge to the second side edge, wherein the third side edge is substantially arc-shaped, a fourth side edge extending from the first side edge opposite the third side edge and forming an obtuse angle relative to the first side edge, and a fifth side edge extending from the second side edge opposite the third side edge and forming an obtuse angle relative to the second side edge and forming a substantially right angle relative to the fourth side edge. The first side edge, the second side edge, the third side edge, the fourth side edge, and the fifth side edge may be rounded. In some embodiments a length of the ski may be approximately 6⅜" and a width of the ski may be approximately 4½".

In some embodiments the third side edge may be configured to allow the power tool to be placed on a work surface and prevent kinking the power cord. The power tool may be a chipping hammer. The third side edge may be configured to allow the chipping hammer to rest on a work surface and a chisel of the chipping hammer to maintain contact with the work surface. In some embodiments the first side wall may be detachably coupled to the bridge.

In some embodiments a power tool ski system may comprise a base configured to couple to a power tool, comprising a side wall configured to conform to the base of the power tool and an end wall coupled to the side wall; and a ski comprising a bridge, a first side wall coupled to a first edge of the bridge, and a second side wall coupled to a second edge of the bridge opposite the first edge of the bridge; wherein the bridge, the first side wall, and the second side wall comprise an upper surface configured to receive a base of a power tool; wherein the bridge, the first side wall, and the second side wall form an opening configured to permit a power cord to pass therethrough and the first side wall and the second side wall are configured to elevate the power tool when located on a surface such the power cord is unkinked; and a securing mechanism coupled to the upper surface and configured to detachably couple to the base of the power tool.

In some embodiments the base may further comprise a notch. The notch may be configured to detachably couple to the securing mechanism.

In some embodiments a method of preventing uptake of grit in power tools may comprise passing a power cord of a power tool through an opening of a ski, wherein the ski comprises a bridge, a first side wall coupled to a first edge of the bridge, and a second side wall coupled to a second edge of the bridge opposite the first edge of the bridge, wherein the bridge, the first side wall, and the second side wall form an opening configured to permit a power cord to pass therethrough; coupling a ski to a base of a power tool, wherein the bridge, the first side wall, and the second side wall comprise an upper surface configured to receive a base of a power tool; securing the ski to the base of the power tool via a securing mechanism coupled to the upper surface and configured to detachably couple to the base of a power tool; operating the power tool while the ski maintains contact with a work surface, wherein the work surface bears the power tool and the ski; and sliding the power tool and ski on the work surface.

In some embodiments coupling the ski to a base of a power tool may further comprise inserting a notch under a lip of the ski, wherein the notch extends from the base and wherein the lip extends from the first side wall to the second side wall. Securing the ski to the base of the power tool may further comprises resting a knob, wherein the knob is coupled to the base, between a first block and a second block of the securing mechanism, such that a first channel of the first block, a third channel of the nob, and a second channel of the second block align; and inserting a securing pin into the first channel, the second channel, and the third channel.

Aspects and applications of the invention presented here are described below in the drawings and detailed description of the invention. Unless specifically noted, it is intended that the words and phrases in the specification and the claims be given their plain, ordinary, and accustomed meaning to those of ordinary skill in the applicable arts. The inventor is fully aware that he can be his own lexicographer if desired. The inventor expressly elects, as his own lexicographers, to use only the plain and ordinary meaning of terms in the specification and claims unless he clearly states otherwise and then further, expressly sets forth the "special" definition of that term and explains how it differs from the plain and ordinary meaning. Absent such clear statements of intent to apply a "special" definition, it is the inventor's intent and desire that the simple, plain and ordinary meaning to the terms be applied to the interpretation of the specification and claims.

The inventor is also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventor is fully informed of the standards and application of the special provisions of pre-AIA 35 U.S.C. § 112, ¶6 and post-AIA 35 U.S.C. § 112(f). Thus, the use of the words "function," "means" or "step" in the Detailed Description or Description of the Drawings or claims is not intended to somehow indicate a desire to invoke the special provisions of pre-AIA 35 U.S.C. § 112, ¶6 or post-AIA 35 U.S.C. § 112(f), to define the invention. To the contrary, if the provisions of pre-AIA 35 U.S.C. § 112, ¶6 or post-AIA 35 U.S.C. § 112(f) are sought to be invoked to define the inventions, the claims will specifically and expressly state the exact phrases "means for" or "step for, and will also recite the word "function" (i.e., will state "means for performing the function of [insert function]"), without also reciting in such phrases any structure, material or act in support of the function. Thus, even when the claims recite a "means for performing the function of . . . " or "step for performing the function of . . . ," if the claims also recite any structure, material or acts in support of that means or step, or that perform the recited function, then it is the clear intention of the inventor not to invoke the provisions of pre-AIA 35 U.S.C. § 112, ¶6 or post-AIA 35 U.S.C. § 112(f). Moreover, even if the provisions of pre-AIA 35 U.S.C. § 112, ¶6 or post-AIA 35 U.S.C. § 112(f) are invoked to define the claimed inventions, it is intended that the inventions not be limited only to the specific structure, material or acts that are described in the preferred embodiments, but in addition, include any and all structures, materials or acts that perform the claimed function as described in alternative embodiments or forms of the invention, or that are well known present or later-developed, equivalent structures, material or acts for performing the claimed function.

The foregoing and other aspects, features, and advantages will be apparent to those artisans of ordinary skill in the art from the DETAILED DESCRIPTION and DRAWINGS, and from the CLAIMS.

BRIEF DESCRIPTION OF THE SEVERAL VIEWS OF THE DRAWINGS

A more complete understanding of the present invention may be derived by referring to the detailed description when considered in connection with the following illustrative figures. In the figures, like reference numbers refer to like elements or acts throughout the figures.

Elements and acts in the figures are illustrated for simplicity and have not necessarily been rendered according to any particular sequence or embodiment.

DETAILED DESCRIPTION

In the following description, and for the purposes of explanation, numerous specific details are set forth in order to provide a thorough understanding of the various aspects of the invention. It will be understood, however, by those skilled in the relevant arts, that the present invention may be practiced without these specific details. In other instances, known structures and devices are shown or discussed more generally in order to avoid obscuring the invention. In many cases, a description of the operation is sufficient to enable one to implement the various forms of the invention, particularly when the operation is to be implemented in software. It should be noted that there are many different and alternative configurations, devices and technologies to which the disclosed inventions may be applied. The full scope of the inventions is not limited to the examples that are described below.

In one application, a novel system for elevating a power tool to prevent uptake of dust, debris, and grit and the wear down of power tool components is provided.

Figure 1:
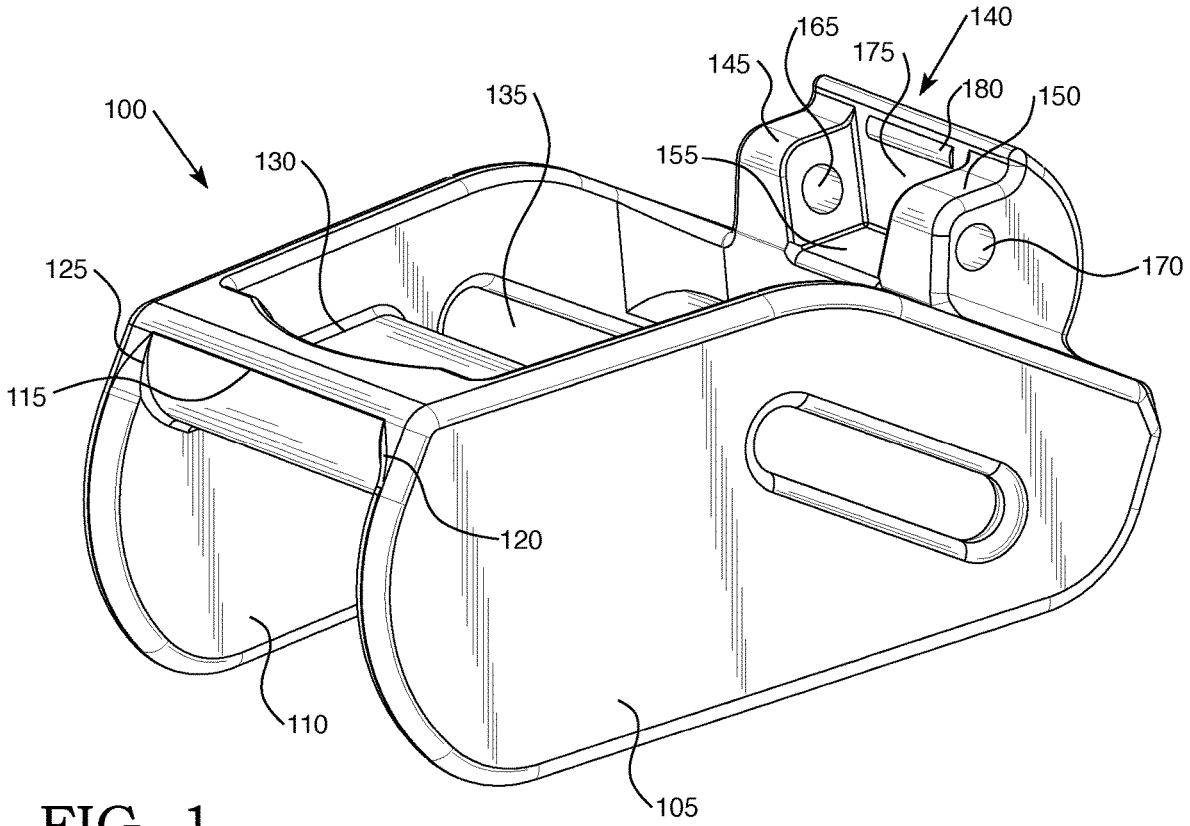
FIG. 1 depicts an oblique view of an implementation of a ski attachment.

FIG. 1 illustrates an exemplary embodiment of a ski or ski accessory for a power tool. In one non-limiting embodiment, the ski 100 comprises a first side wall 105, a second side wall 110, and a bridge 115. A first edge 120 of the bridge 115 is coupled to the first side wall 105 and a second edge 125 of the bridge 115 is coupled to the second side wall 110. Together, the first side wall 105, the second side wall 110, and the bridge 115 comprise an upper surface 130. The upper surface is configured to receive a base 900 of a power tool 2300. In some embodiments, the power tool 2300 is a chipping hammer, rotary hammer, demolition hammer, driver, pneumatic hammer, drill, saw, circular saw, jig saw, miter saw, impact driver, nail gun, router, sander, grinder, rotary tool, concrete drill, or any other power tool. In one embodiment, the upper surface 130 is configured and formed to receive an existing base 900 of a power tool 2300. In another embodiment, a custom base 900 is configured to couple to a power tool 2300 and the upper surface 130. In some embodiments, the custom base 900 is 3-D printed to substantially mimic the existing base 900 of a power tool 2300.

In some embodiments the first side wall 105, the second side wall 110, and the bridge 115 form an opening 135 which is configured to permit a power cord 2305 to pass therethrough. The opening 135 facilitates a space for corded power tools, which have a power cord 2305 extending from the base, to maintain an appropriate orientation without having to alter the power tool 2300 or power cord 2305. The opening 135 also provides enough space to reduce kinking and bending.

In some implementations the first side wall 105 and the second side wall 110 are configured to elevate the base 900 of the power tool 2300 from a work surface 2310 when coupled to the base 900 of a power tool 2300 and configured to prevent contact between the base 900 of the power tool 2300 and the work surface 2310 when coupled to the base 900 of the power tool 2300. By elevating the base 900 of the power tool 2300 from the work surface 2310, the power tool 2300 is not exposed to the dust, dirt, and grit that is on the work surface. The dust, dirt, and grit may be produced by the action of the power tool 2300 or may be a part of the environment of the work surface 2310. Dust, dirt, and grit is very damaging to the components of the power tool 2300, especially when brought into the intake of the power tool 2300. When dust, dirt, and grit are brought into the power tool 2300 through the intake, the inner components such as the motor, cords, switch, armature, brush, or others are especially susceptible to damage from intaking dirt, dust, and grit. These repairs and replacements are very costly and time intensive and have to be done significantly more frequent frequently when dust, dirt, and grit is brought into the power tool 2300. Furthermore, by elevating the power tool 2300, there is less strain and friction on the power cord 2305 of the power tool 2300 when at rest or when in motion and will not have the typical wear and tear that will necessitate repairs and replacement parts.

Figure 27:
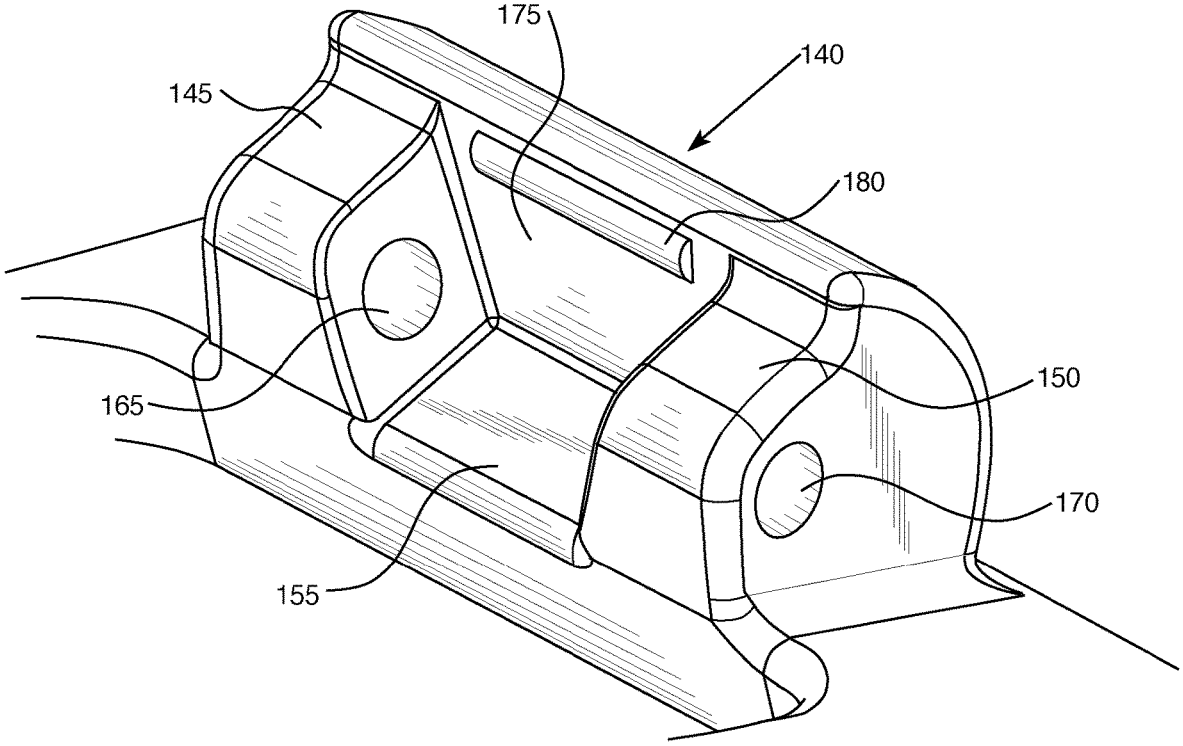
FIG. 27 depicts and oblique view of the securing mechanism.

In other embodiments, a securing mechanism 140 is coupled to the upper surface 130. The securing mechanism 140 is configured to detachable couple to the base 900 of the power tool 2300. It can be appreciated by those of ordinary skill in the art that the securing mechanism 140 may be selected from any of the many types of securing mechanisms. Such securing mechanisms 140 include bolts, clasps, notches, mounts, latches, anchors, pins, hook and loop fasteners, magnets, and others. In one implementation the securing mechanism 140 comprises a first block 145 and a second block 150. The first block 145 is located distal from the second block 150. This provides a receiving space between the first block 145 and the second block 150. In some implementations, a receiving shelf 155 is located between the first block 145 and the second block 150. The first block 145 and the second block 150 each form a first channel 165 and a second channel 170. The securing mechanism 140 may further comprise back wall 175. The back wall 175 may be coupled to the first block 145, the second block 150, and the receiving shelf 155. The back wall 175 may further comprise a stability tab 180. The stability tab 180 may be configured to produce support for holding in or anchoring the base 900 of a power tool 2300 to the ski 100. FIG. 27 gives a closer depiction of the securing mechanism 140.

Figure 2:
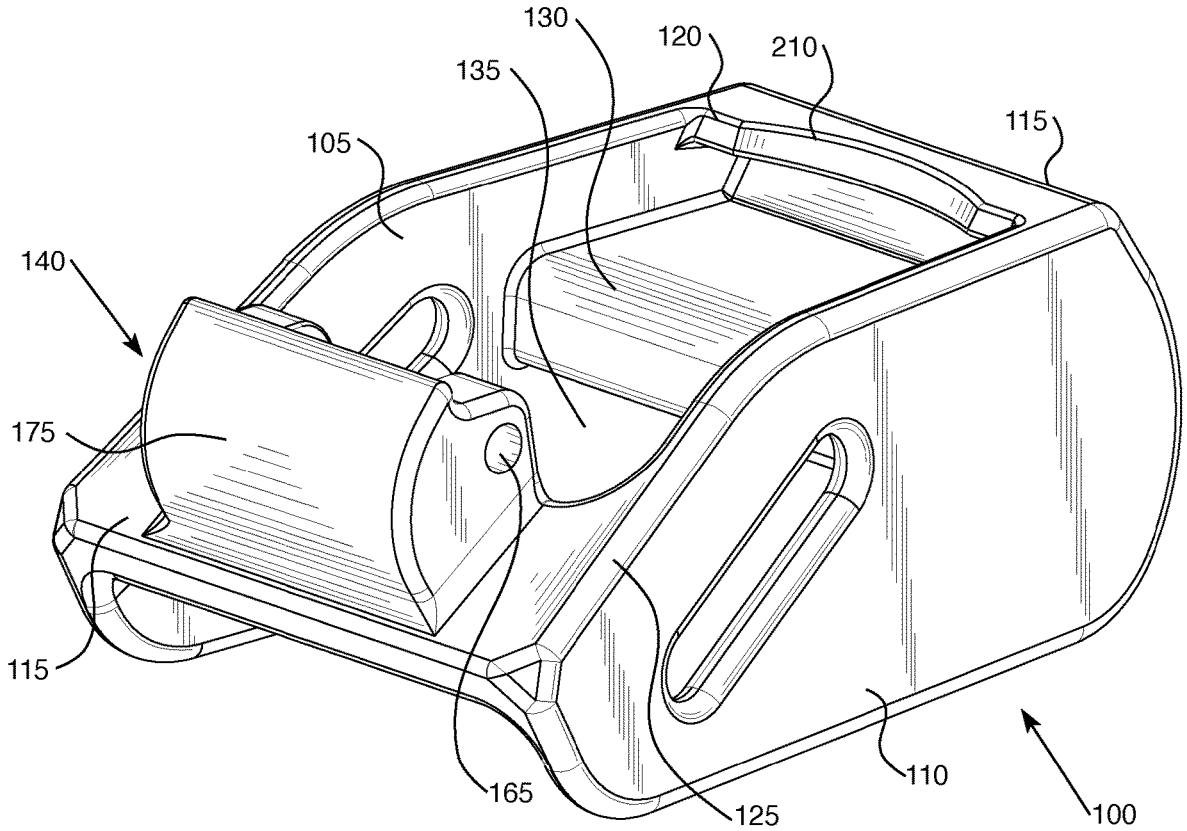
FIG. 2 depicts an oblique view of an implementation of a ski attachment from a second view.

FIG. 2 illustrates a second oblique view of the topside of the ski 100. In particular, it illustrates an exemplary embodiment of the upper surface 130 of the ski 100. The upper surface 130 may further comprise lip 210. The lip 210 may be located distal from the securing mechanism 140. The lip 210 may extend from the first side wall 105 to the second side wall 110.

Figure 3:
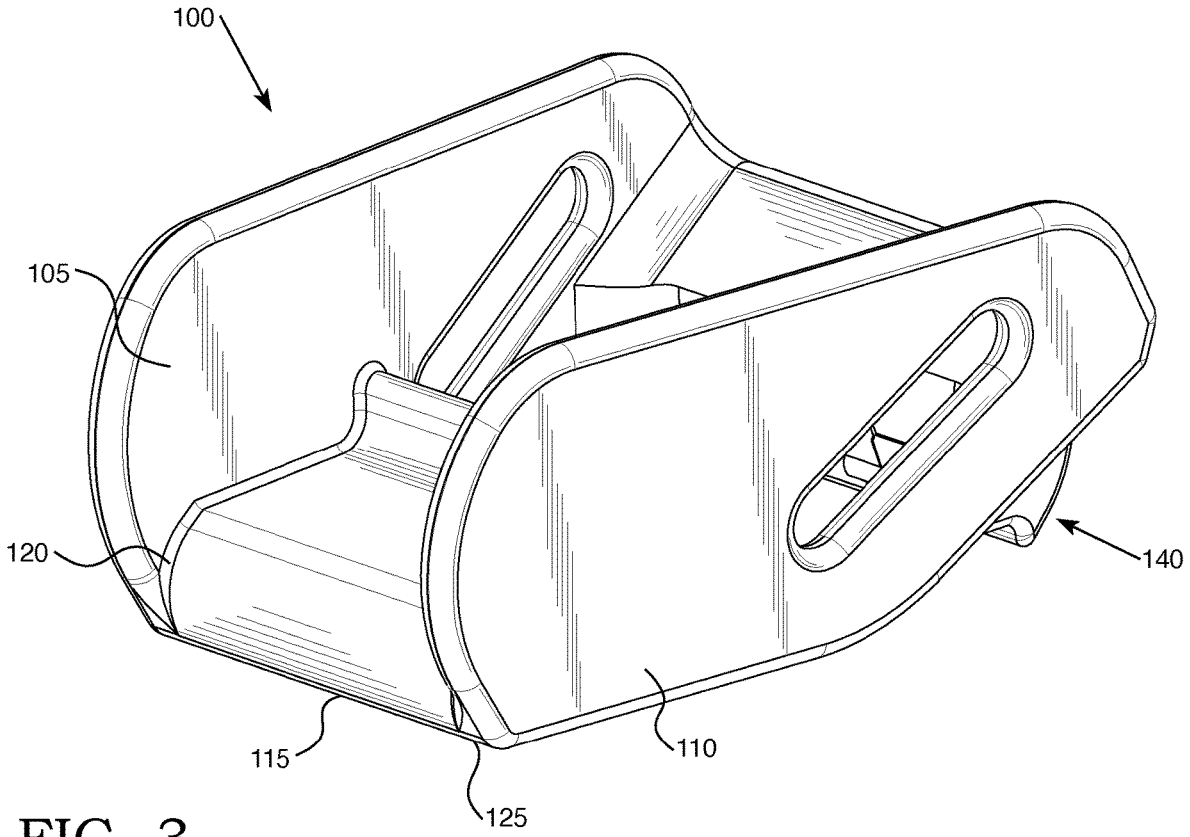
FIG. 3 depicts an oblique view of an implementation of a ski attachment from a bottom side.
Figure 4:
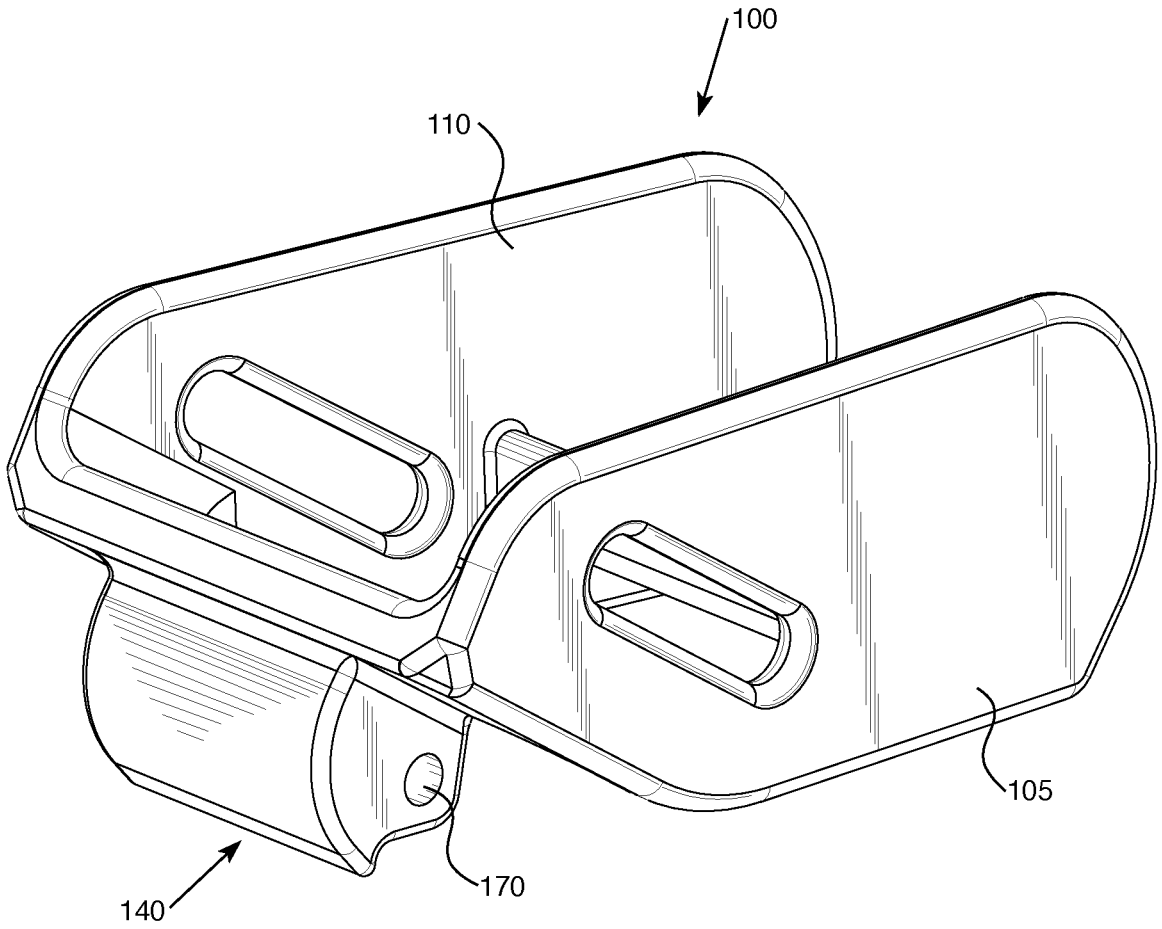
FIG. 4 depicts an oblique view of an implementation of a ski attachment from a second view on a bottom side.

FIG. 3 and FIG. 4 illustrate oblique views of the underside of the ski 100.

Figure 5:
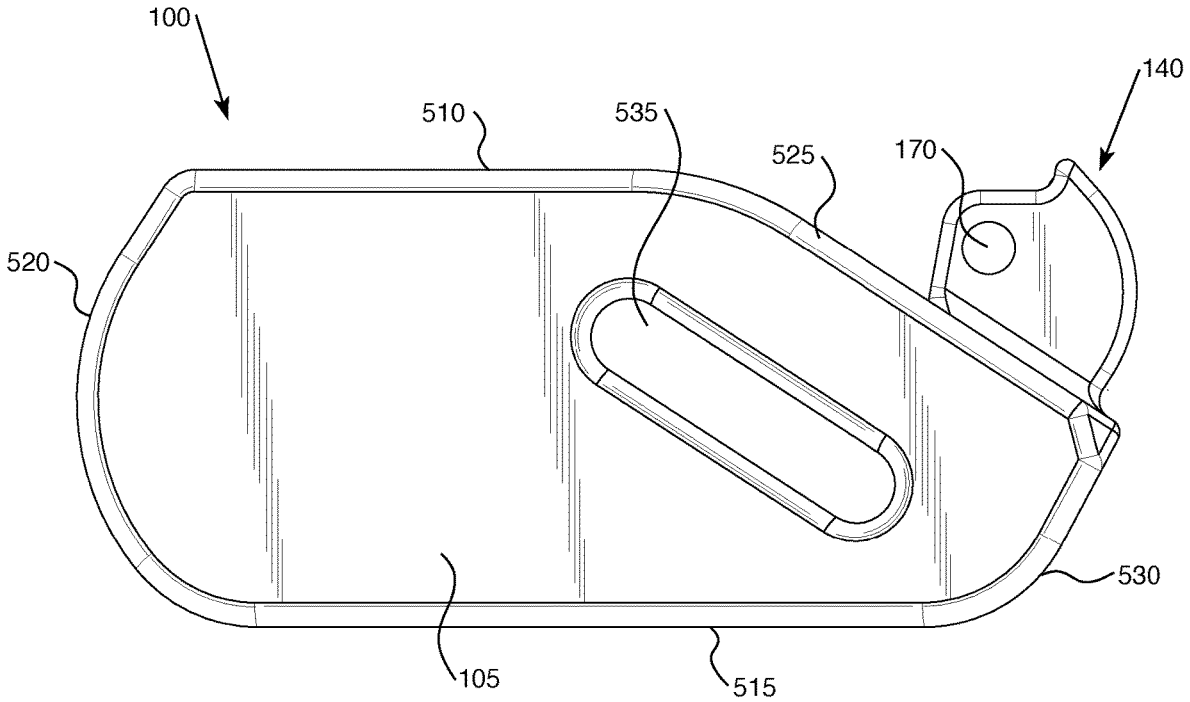
FIG. 5 depicts a side view of an implementation of a ski attachment.

FIG. 5 illustrates a side view of the ski 100. In this embodiment, the first side wall 105 and the second side wall 110 each comprise a first side edge 510, a second side edge 515, a third side edge 520, a fourth side edge 525, and a fifth side edge 530. In some embodiments the first side edge 510 and the second side edge 515 are substantially parallel. The third side edge 520 extends from the first side edge 510 to the second side edge 515. In some implementations the third side edge 520 may be substantially arc-shaped. The fourth side edge 525 extends from the first side edge 510, opposite the third side edge 520, and forms an obtuse angle relative to the first side edge 510. The fifth side edge 530 extends from the second side edge 515, opposite the third side edge 520, and forms an obtuse angle relative to the second side edge 515. The fifth side edge 530 forms a substantially right angle relative to the fourth side edge 525. In some embodiments the first side edge 510, the second side edge 515, the third side edge 520, the fourth side edge 525, and the fifth side edge 530 are rounded. The design allows for the power tool 2300, when coupled to the ski 100, to be rested a work surface 2310 without tipping over or damaging the power cord 2305 or, when rocked forward to rest on the third side edge 520, may be rested on the work surface 2310 while in a position for use. In some embodiments the power tool 2300 may be a chipping hammer and the third side edge 520 of the ski 100 may be configured to allow the chipping hammer to rest on a work surface 2310 and a chisel of the chipping hammer to maintain contact with the work surface 2310. This also provides elevation of the base 900 of the power tool 2300 from off of the work surface 2310 such that any dust, dirt, or grit that is on the work surface 2310 or created by the use of the power tool 2300 will not be brought into the intake of the power tool 2300. In some embodiments, the first side wall 105 and the second side wall 110 may further comprise a vent 535.

In other exemplary embodiment first side edge 510, the second side edge 515, the third side edge 520, the fourth side edge 525, and the fifth side edge 530 are rounded. The dimensions of various embodiments may change depending on the size of the power tool and the varying purposes for which it is used. However, in one embodiment, the ski has a length of approximately 6⅜", a width of approximately 4½", and a height of approximately 3". The length of the ski may be in the range of 3" to 15", 4" to 12", 5" to 9", or 6" to 7". The width of the ski may be in the range of 1" to 12", 2" to 10", or 3" to 7", or 4" to 6". Because the skis may be non-parallel, the width of the ski may vary across the length of the ski. For example, the ski may be 3½" wide at a first edge 805 the bridge and 4½" wide at a first edge 805 the bridge 115. Any combination of the of ranges may be applied to each of the narrow portion of the ski and the wide portion of the ski. In another embodiment the height of the ski may be in the range of 1" to 8", 2" to 6", or 3" to 4". These ranges are not to be construed as limiting as the dimensions of the ski should correspond to the power tool that is being used, accordingly, the dimensions of the ski may be altered to best conform with the type and size of power tool being used.

Figure 6:
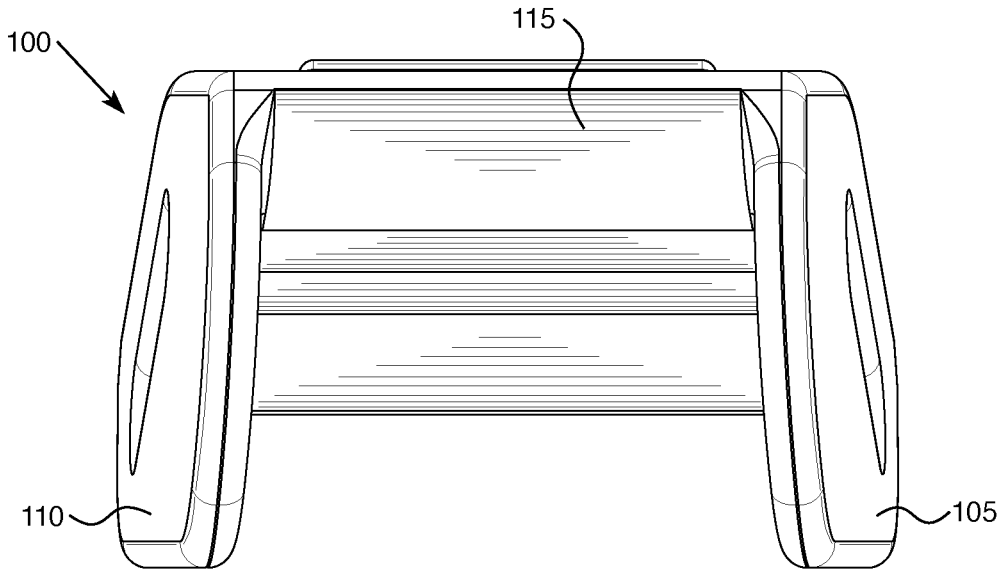
FIG. 6 depicts a frontal view of an implementation of a ski attachment.
Figure 7:
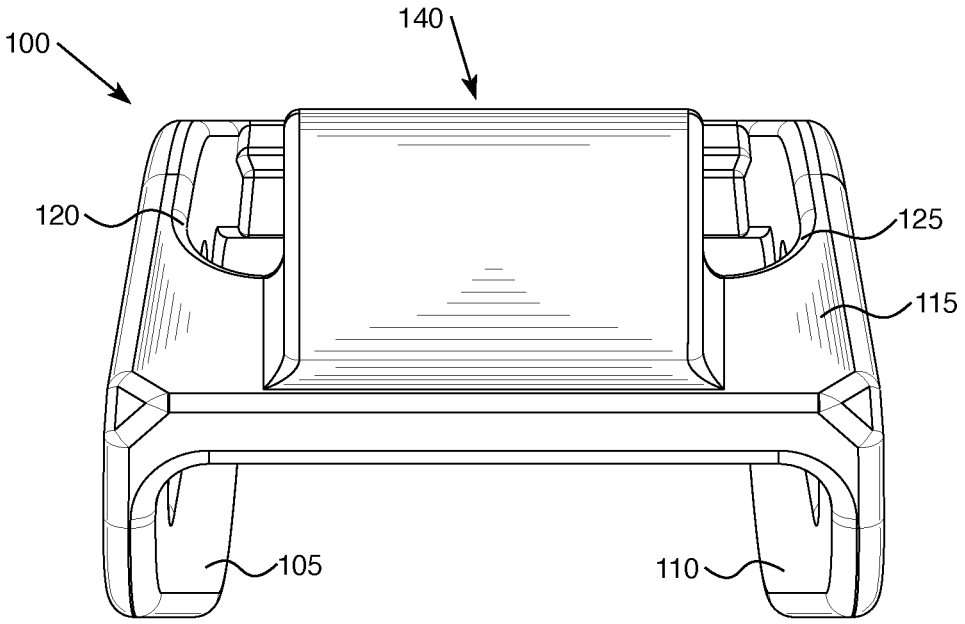
FIG. 7 depicts a rear view of an implementation of a ski attachment.

FIG. 6 and FIG. 7 illustrate a front and a back view of the ski 100. In some embodiments the first side wall 105 and the second side wall 110 are substantially parallel. In another embodiment, the first side wall 105 and the second side wall 110 are non-parallel. This may be determined by the mode of coupling the first side wall 105 and the second side wall 110 to the bridge 1115. In some exemplary embodiments, the first side wall 105 and the second side wall 110 may be coupled to the bridge 115 such that the first side wall 105 and the second side wall 110 form obtuse angles relative to the bridge 115. In this example, a distance between the second side edges 515 of the first side wall 105 and the second side wall is greater than the first side edges 510 of the first side wall 105 and the second side wall 110. In another embodiment, the first side wall 105 and the second side wall 110 may be coupled to the bridge 115 such that the first side wall 105 and the second side wall 110 for acute angles relative to the bridge.

Figure 8:
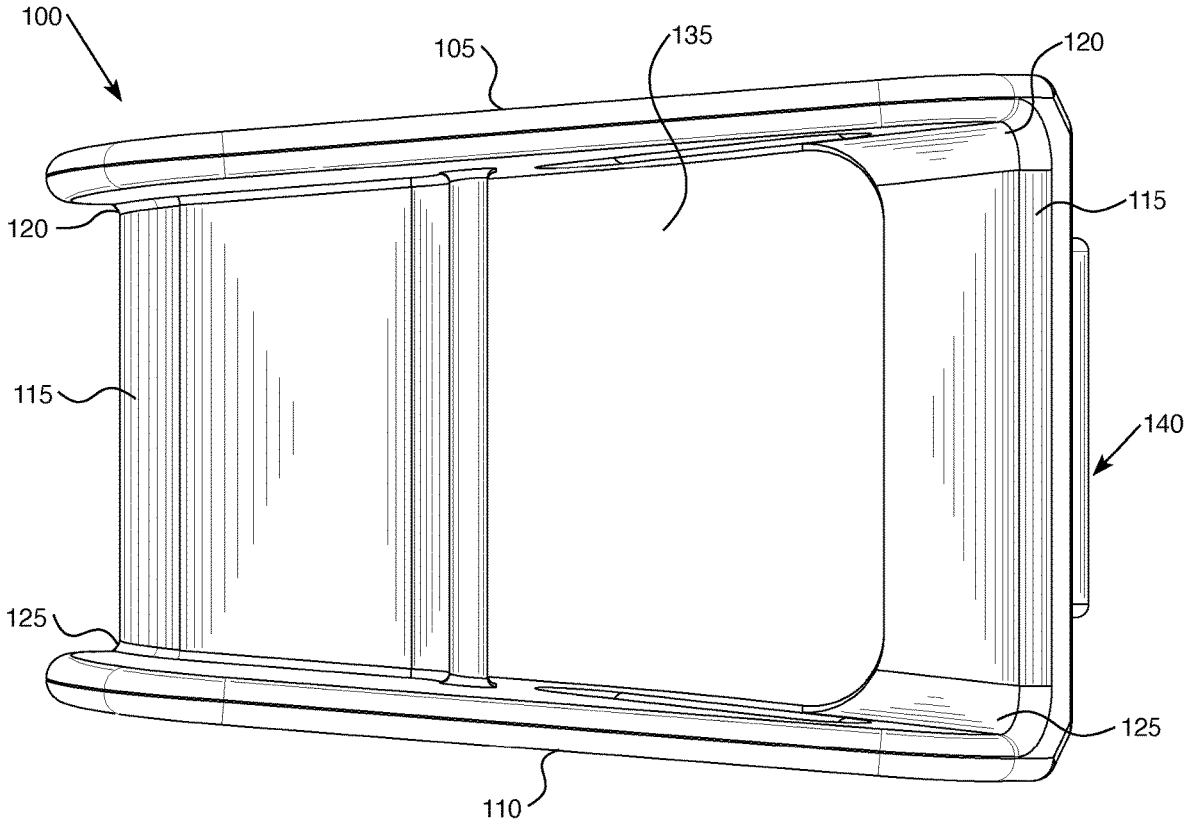
FIG. 8 depicts a bottom view of an implementation of a ski attachment.

FIG. 8 illustrates a bottom view of the ski 100. This view demonstrates another non-limiting implementation in which the first side wall 105 and the second side wall 110 are non-parallel relative to each other. In this embodiment, the bridge 115 is wider at a first edge 805 of the bridge 115 than at the second edge 810 of the bridge 115.

Figure 9:
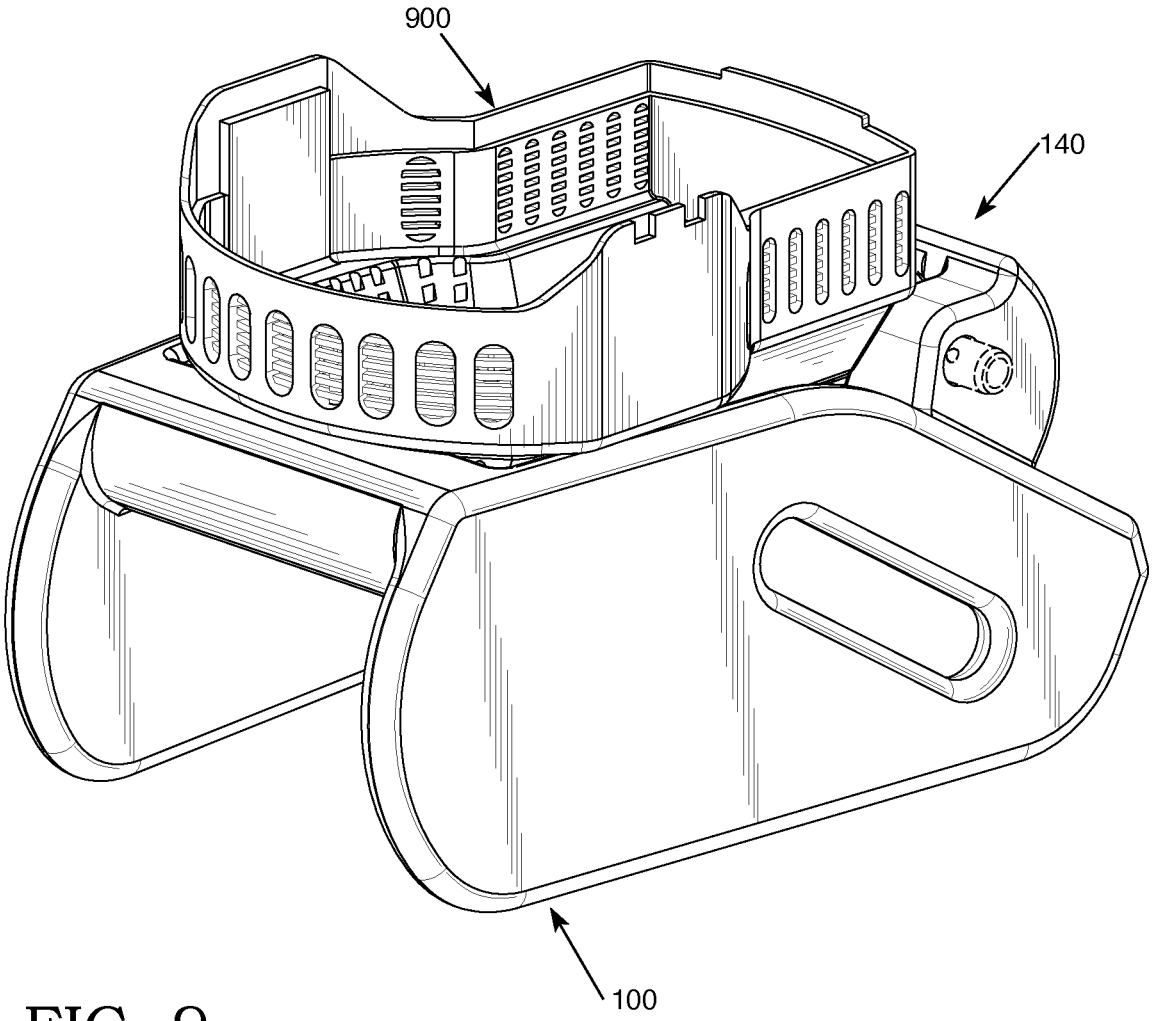
FIG. 9 depicts an oblique view of an implementation of a ski attachment and a power tool base.
Figure 10:
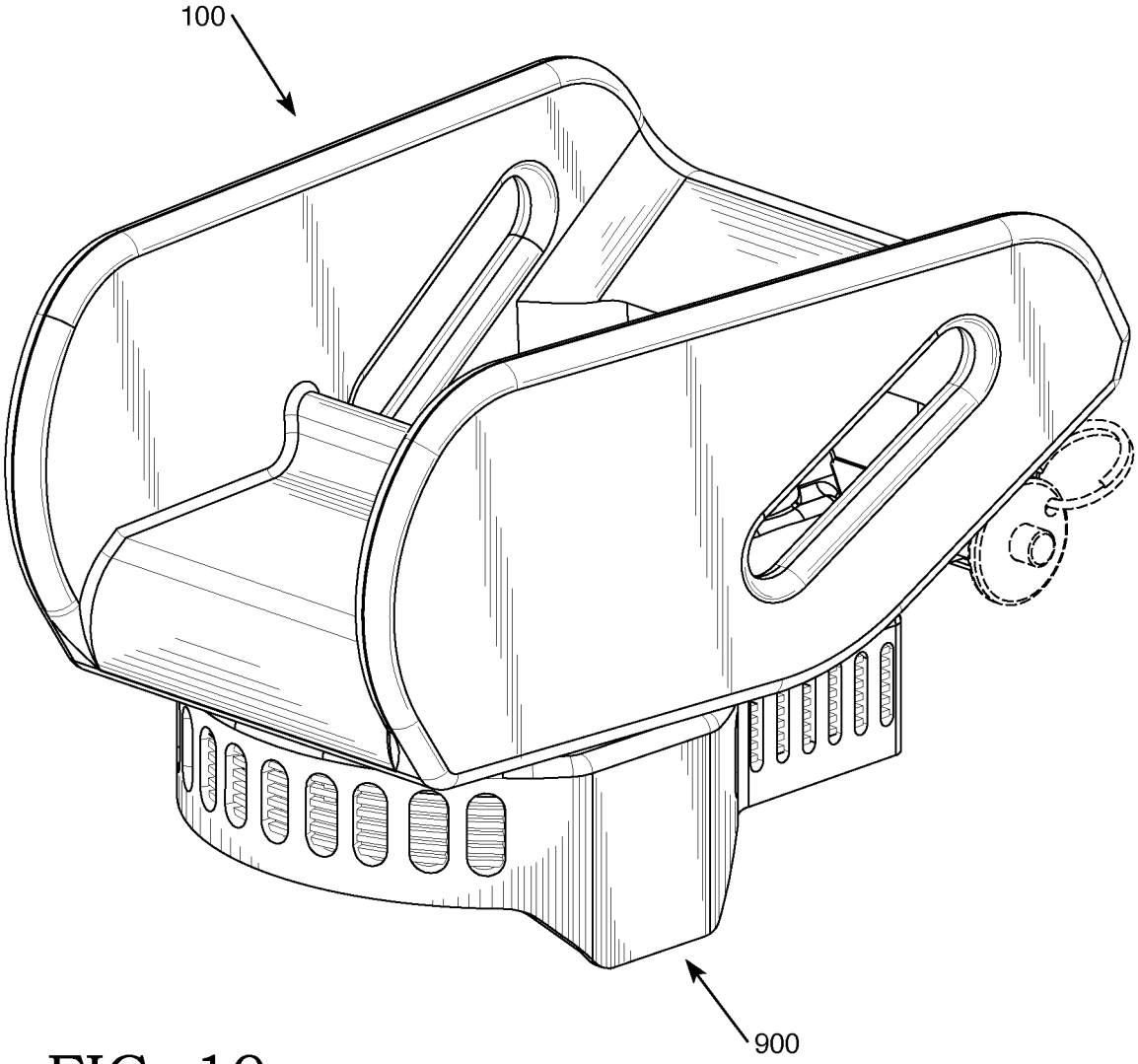
FIG. 10 depicts an oblique view of an implementation of a ski attachment and a power tool base from a bottom side.

FIG. 9 and FIG. 10 illustrate exemplary embodiments of a base 900 of a power tool 2300 coupled to the ski 100. In some exemplary embodiments, the base 900 may be the existing base 900 of a power tool. In other embodiments, the base 900 may be a custom made to properly couple to the power tool 2300 and the ski 100. In other embodiments, a base 900 and a ski 100 may be coupled together as one element or as one piece.

Figure 11:
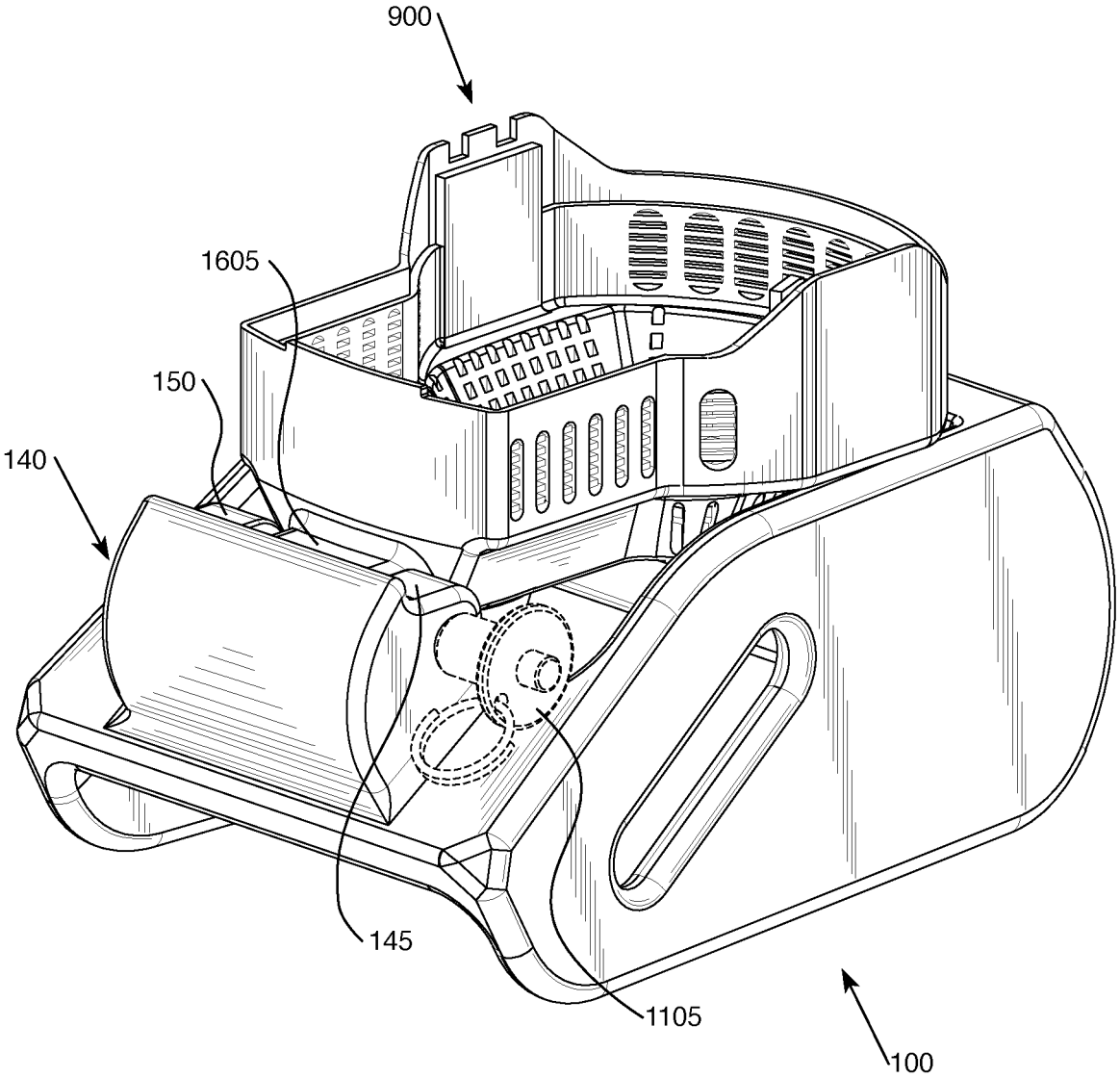
FIG. 11 depicts an oblique view of an implementation of a ski attachment and a power tool base from a second view.
Figure 12:
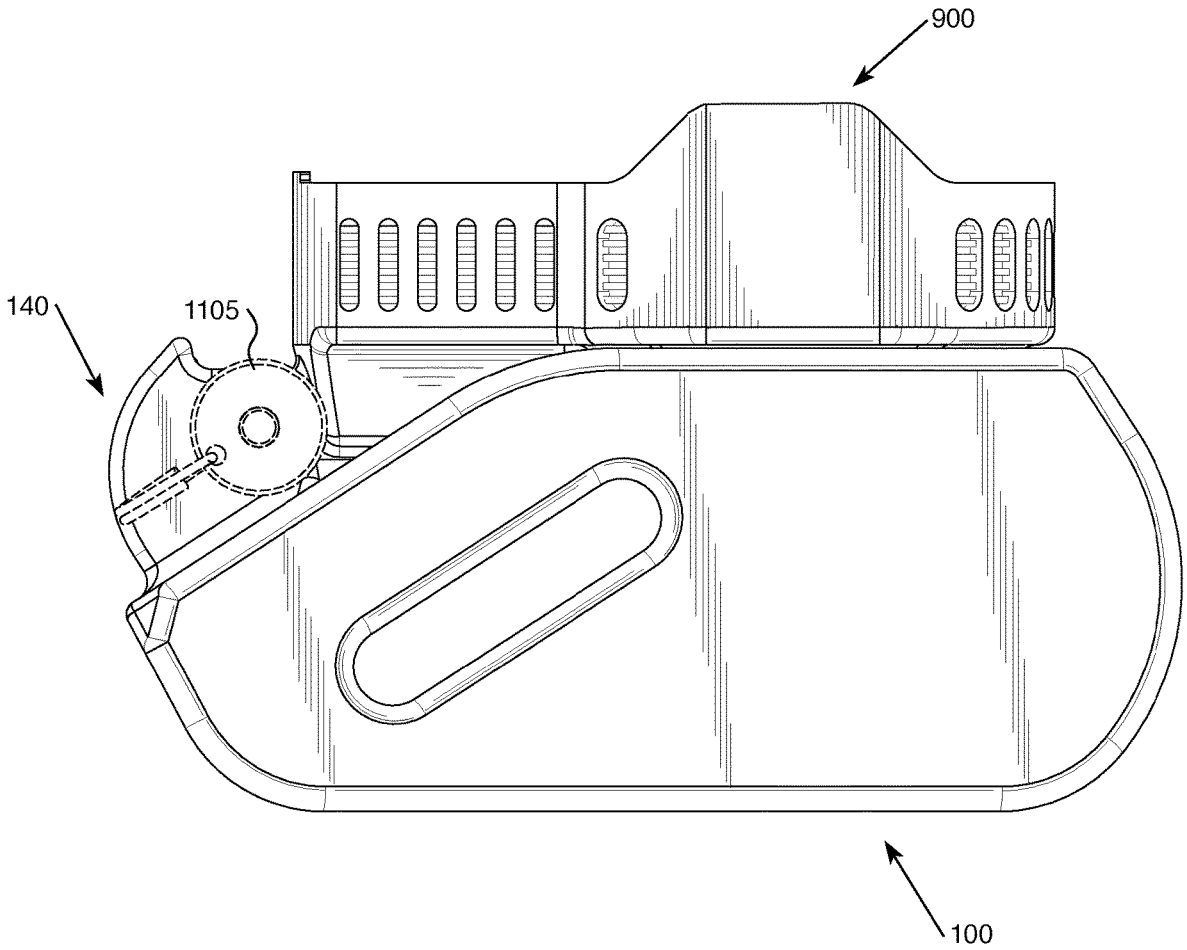
FIG. 12 depicts a side view of an implementation of a ski attachment and a power tool base.
Figure 13:
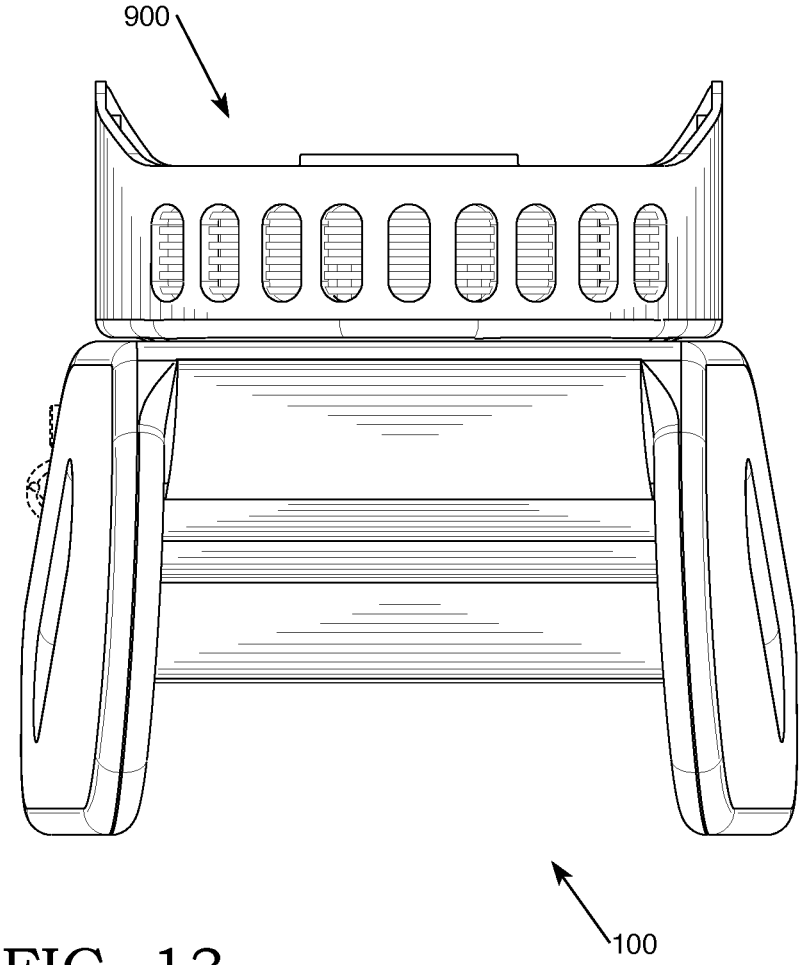
FIG. 13 depicts a frontal view of an implementation of a ski attachment and a power tool base.
Figure 14:
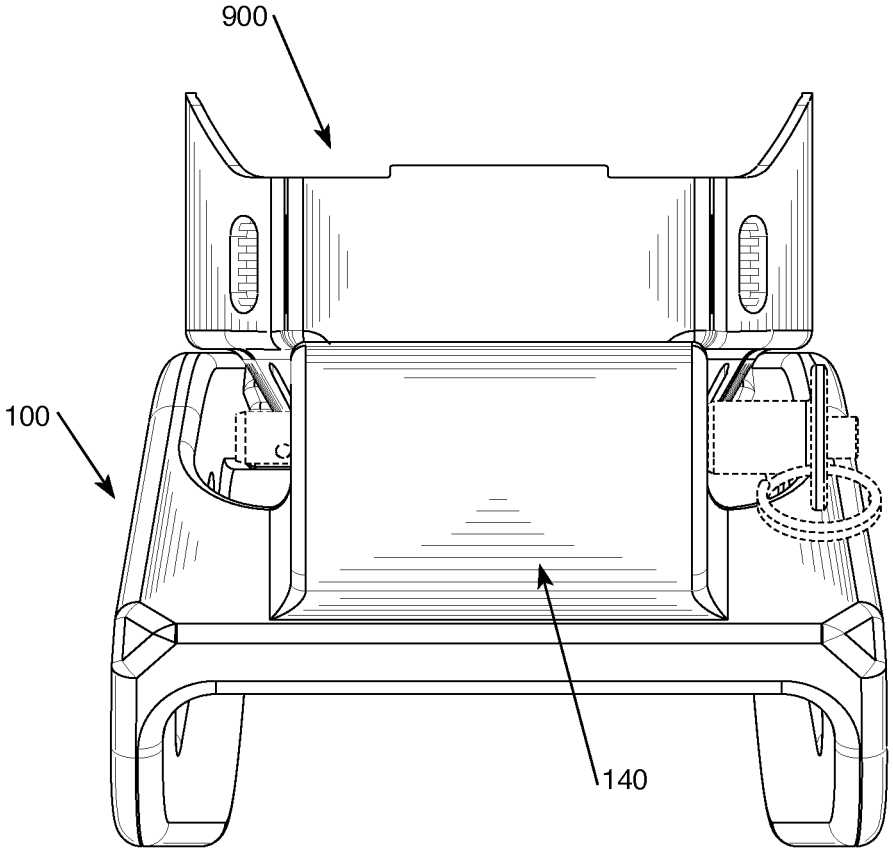
FIG. 14 depicts a rear view of an implementation of a ski attachment and a power tool base.
Figure 15:
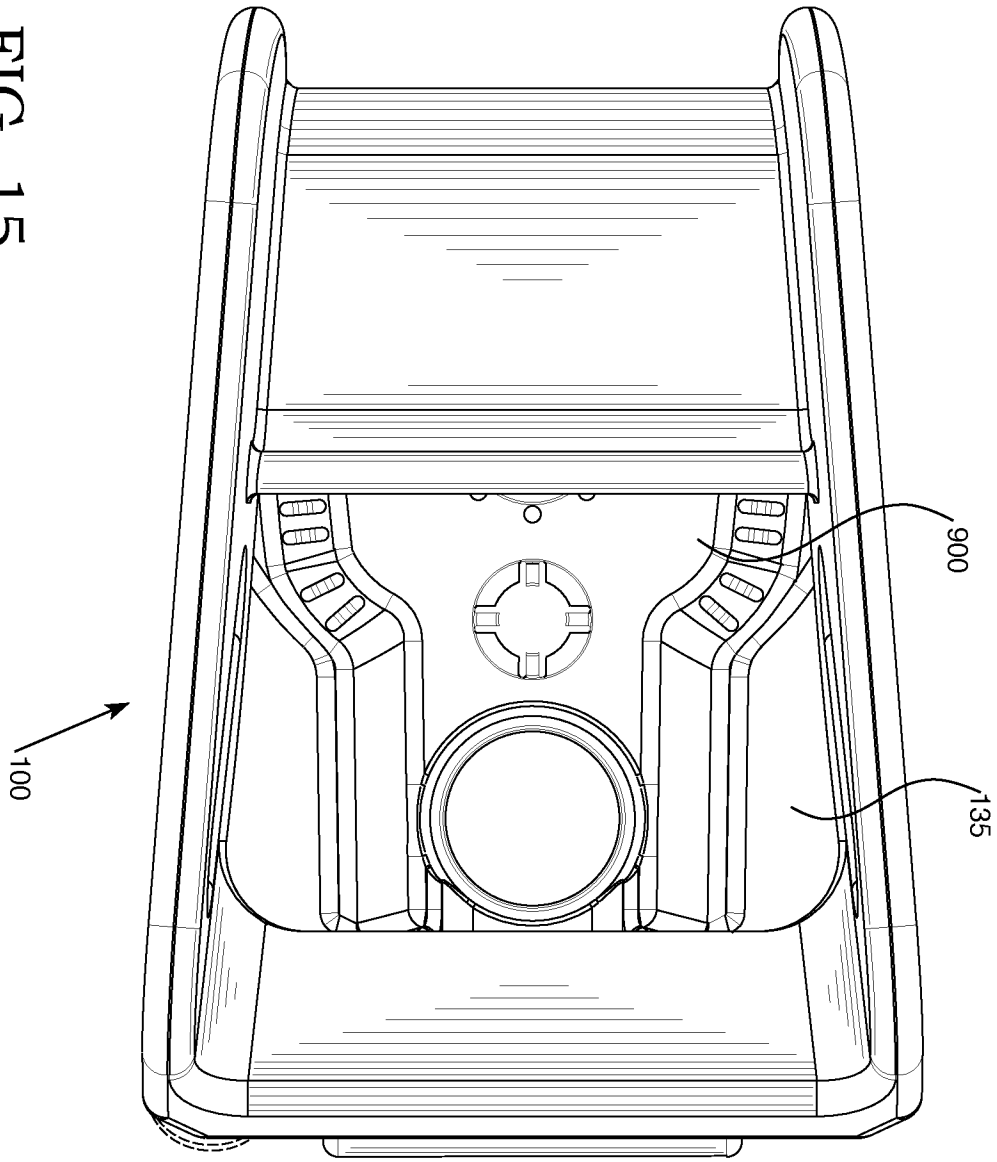
FIG. 15 depicts a bottom view of an implementation of a ski attachment and a power tool base.

FIG. 11 illustrates an implementation the securing mechanism 140 engaging the base 900. In this exemplary embodiment, a knob 1605 coupled to the base 900 rests between the first block 145 and the second block 150 and on top of the receiving shelf 155. The knob 1605 comprises a third channel 1610 which aligns with the first channel 165 and the second channel 170, such that a securing pin can be inserted through the first channel 165, the third channel 1610, and the second channel 170. This secures the base 900 of the power tool 2300 to the ski 100. Other securing mechanisms 140 may be implemented as previously presented.

FIG. 12-FIG. 15 illustrate various views of the base 900 engaged with the ski 100.

Figure 16:
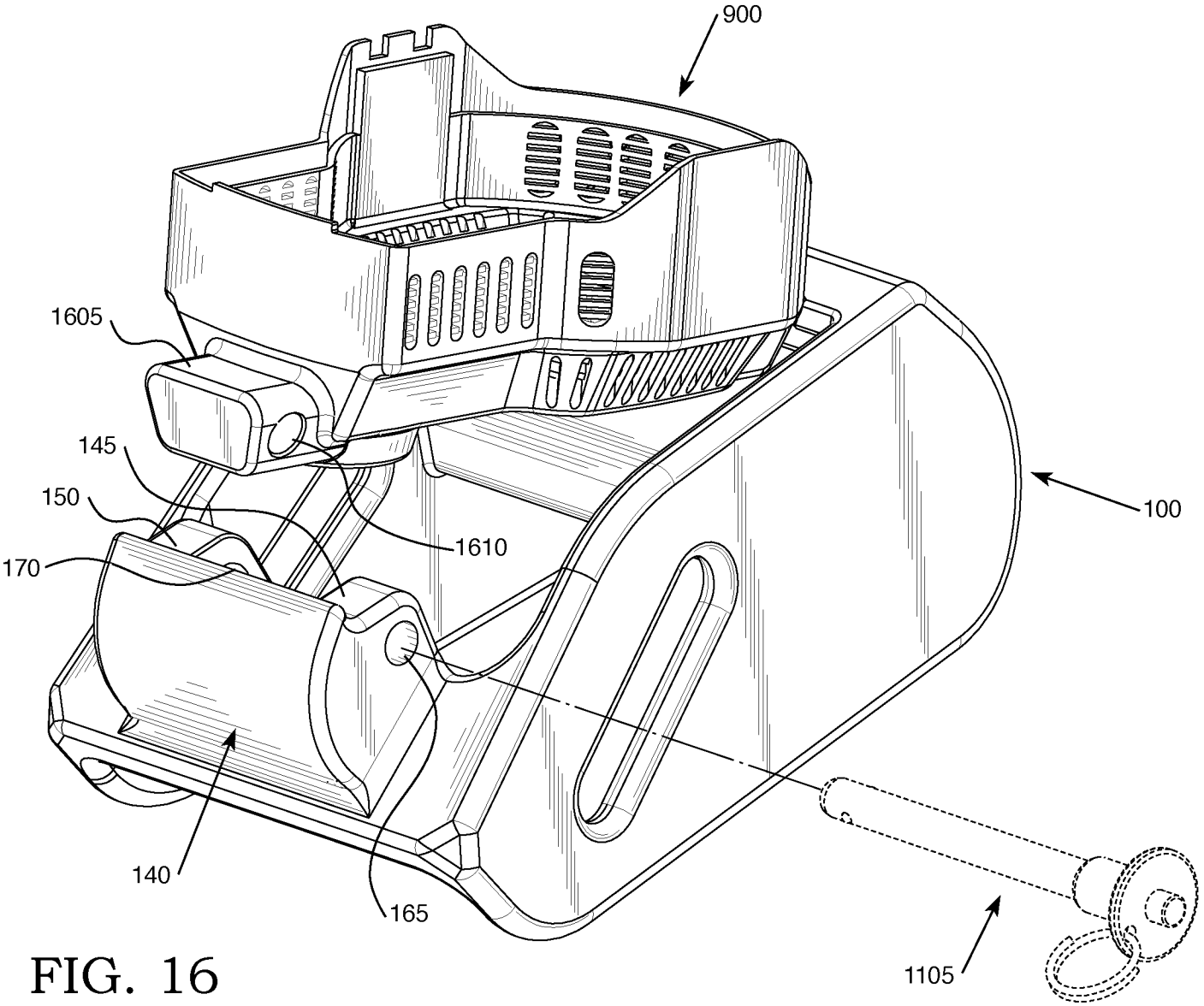
FIG. 16 depicts an oblique view of an implementation of a ski attachment and a power tool base, more specifically a securing mechanism.
Figure 17:
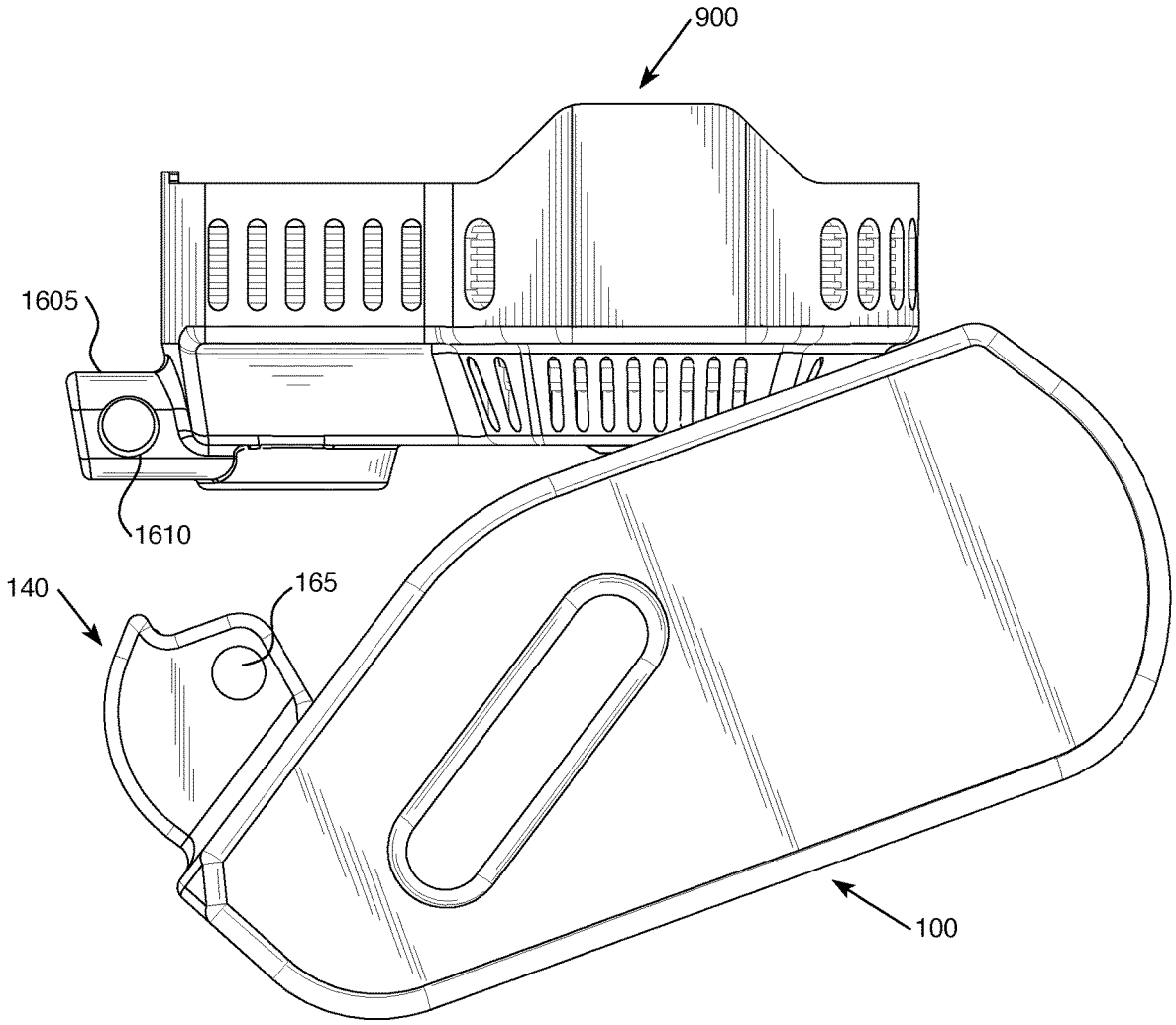
FIG. 17 depicts a side view of an implementation of a ski attachment and a power tool base, more specifically a securing mechanism.

FIG. 16 and FIG. 17 illustrates an implementation of a base 900 partially coupled to the ski 100. This embodiment particularly demonstrates one embodiment in which a securing pin 1105 is used to secure the base 900 to the ski 100.

Figure 18:
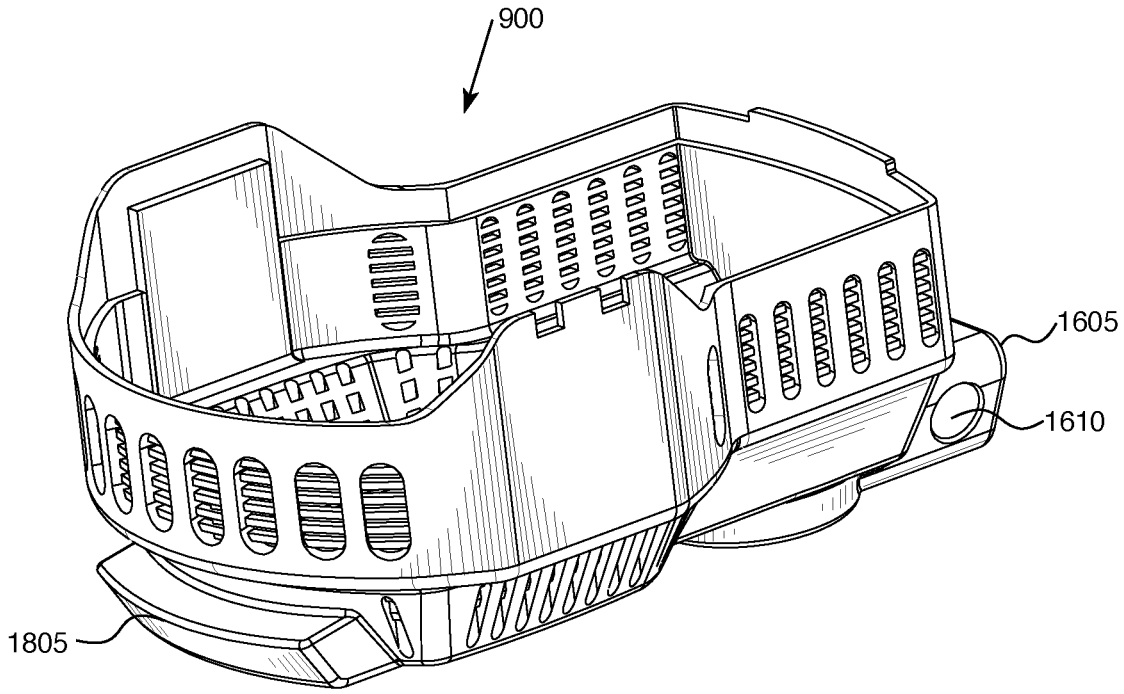
FIG. 18 depicts an oblique view of a power tool base.
Figure 19:
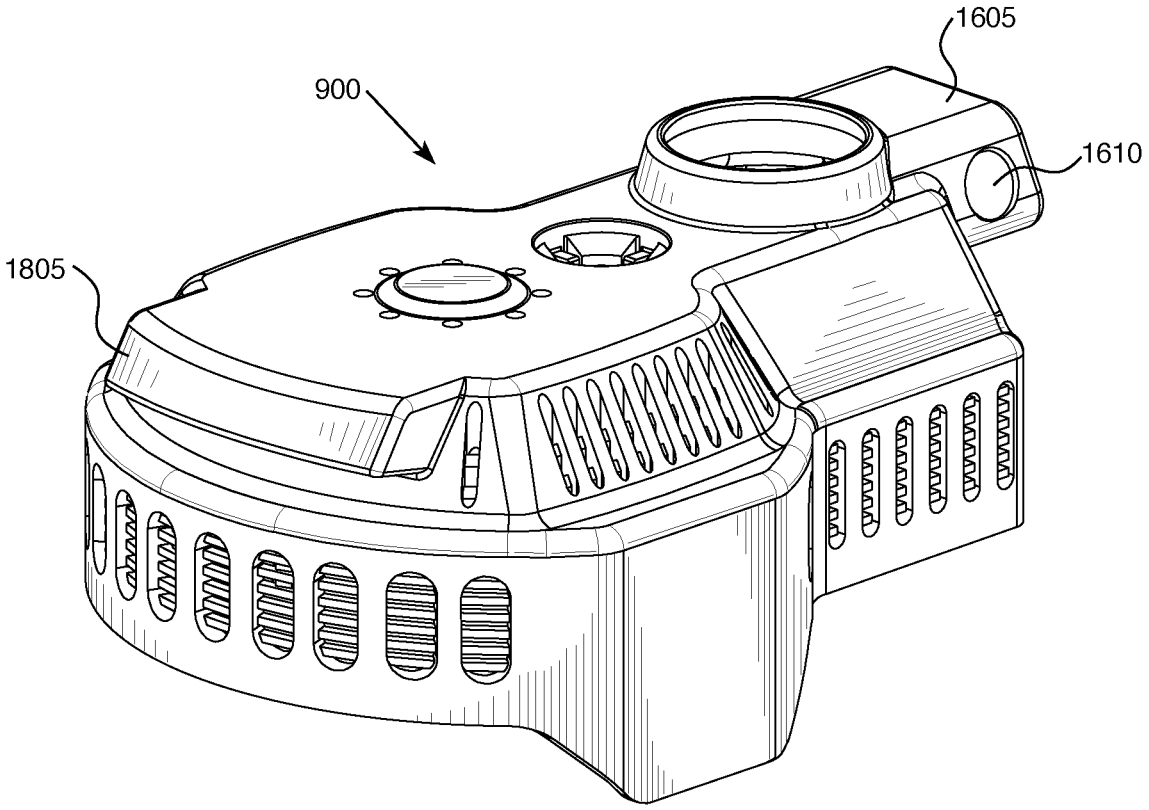
FIG. 19 depicts an oblique view of a power tool base on a bottom side.
Figure 20:
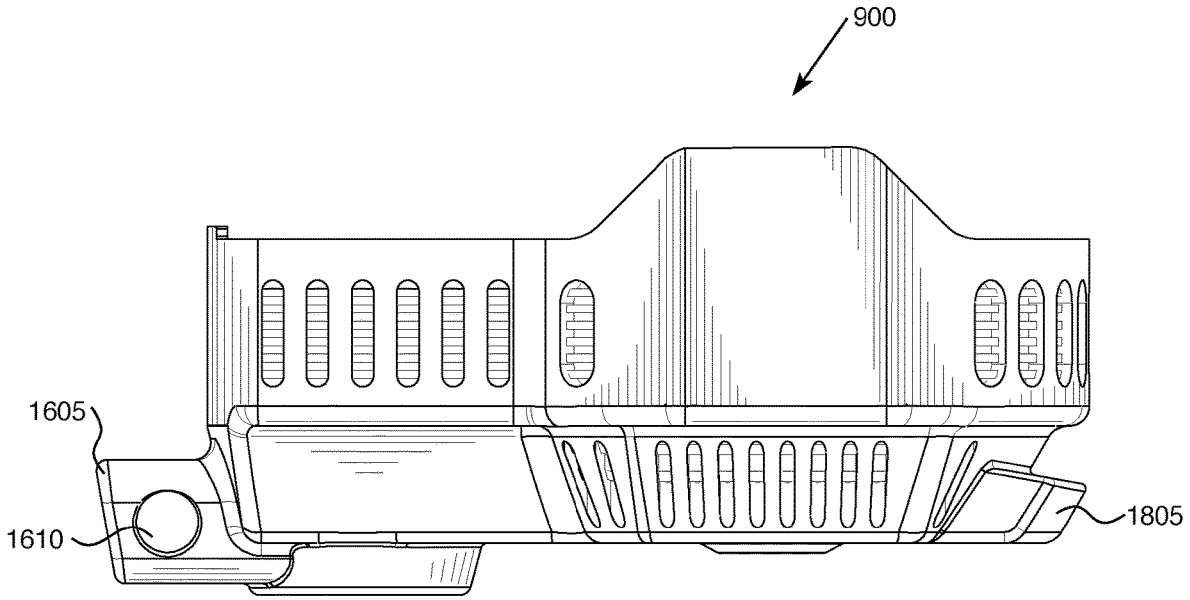
FIG. 20 depicts a side view of a power tool base.
Figure 21:
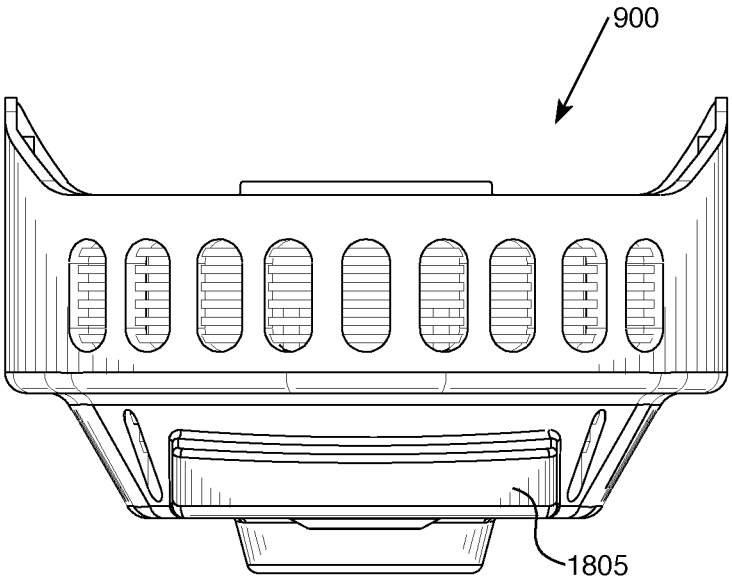
FIG. 21 depicts a rear view of a power tool base.
Figure 22:
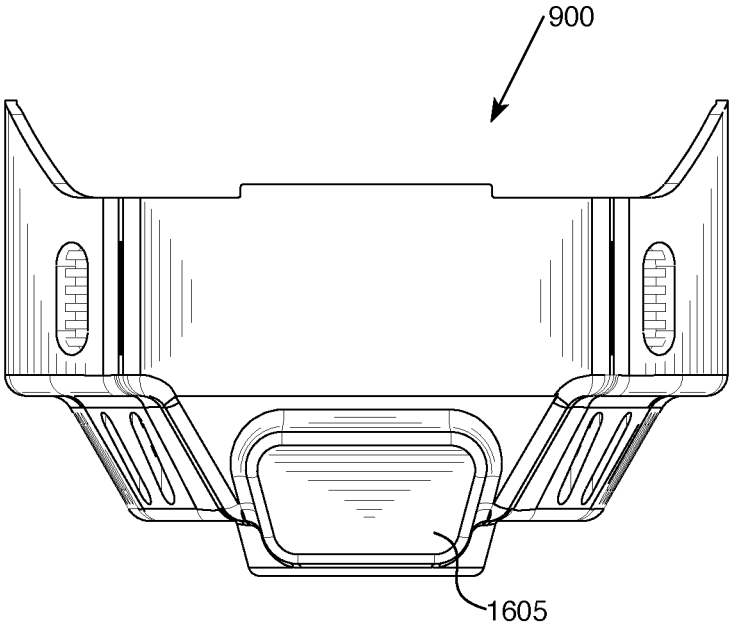
FIG. 22 depicts a frontal view of a power tool base.

FIG. 18 illustrates an implementation of a base 900 which has been custom prepared to couple to the ski 100. In one exemplary implementation, the base 900 has a notch 1805 extending from the base 900. The notch 1805 may be inserted under the lip 210 of the ski 100. When the notch 1805 is inserted under the lip 210 and the securing pin 1105 is inserted through the first channel 165, the third channel 1610, and the second channel 170, the base 900 is securely coupled to the ski 100.

FIG. 19-FIG. 22 illustrate various views of the base 900. As previously stated, the original base 900 may be used, or a custom base 900 may be produced. Custom bases 900 can be produced to mimic the original base 900, such as providing the same ventilation, notches, guards, clips, and ports. The base 900 can be custom produced to conform to the ski 100.

FIG. 23-FIG. 26 illustrate a power tool 2300, a base 900, and a ski 100. In an exemplary embodiment, a power cord 2305 passes through the opening 135 of the ski 100. Many power tools 2300 have the power cord 2305 extending from the base 900 or bottom of the power tool 2300. This can cause problems when the power tool 2300 is placed on the work surface 2310, especially when the power tool 2300 is operated while in contact with the work surface 2310. The power cord 2305 can easily bend, kink, and fray from the pressure and friction caused by the weight and motion of the power tool 2300 across the work surface 2310. The ski 100 provides elevation to prevent kinking and bending and the weight of the power tool 2300 rests on the ski 100, so when the power tool 2300 is moving across the work surface 2310, the ski 100 is bearing the weight and experiencing the friction, thus preserving the power cord 2305.

Figure 23:
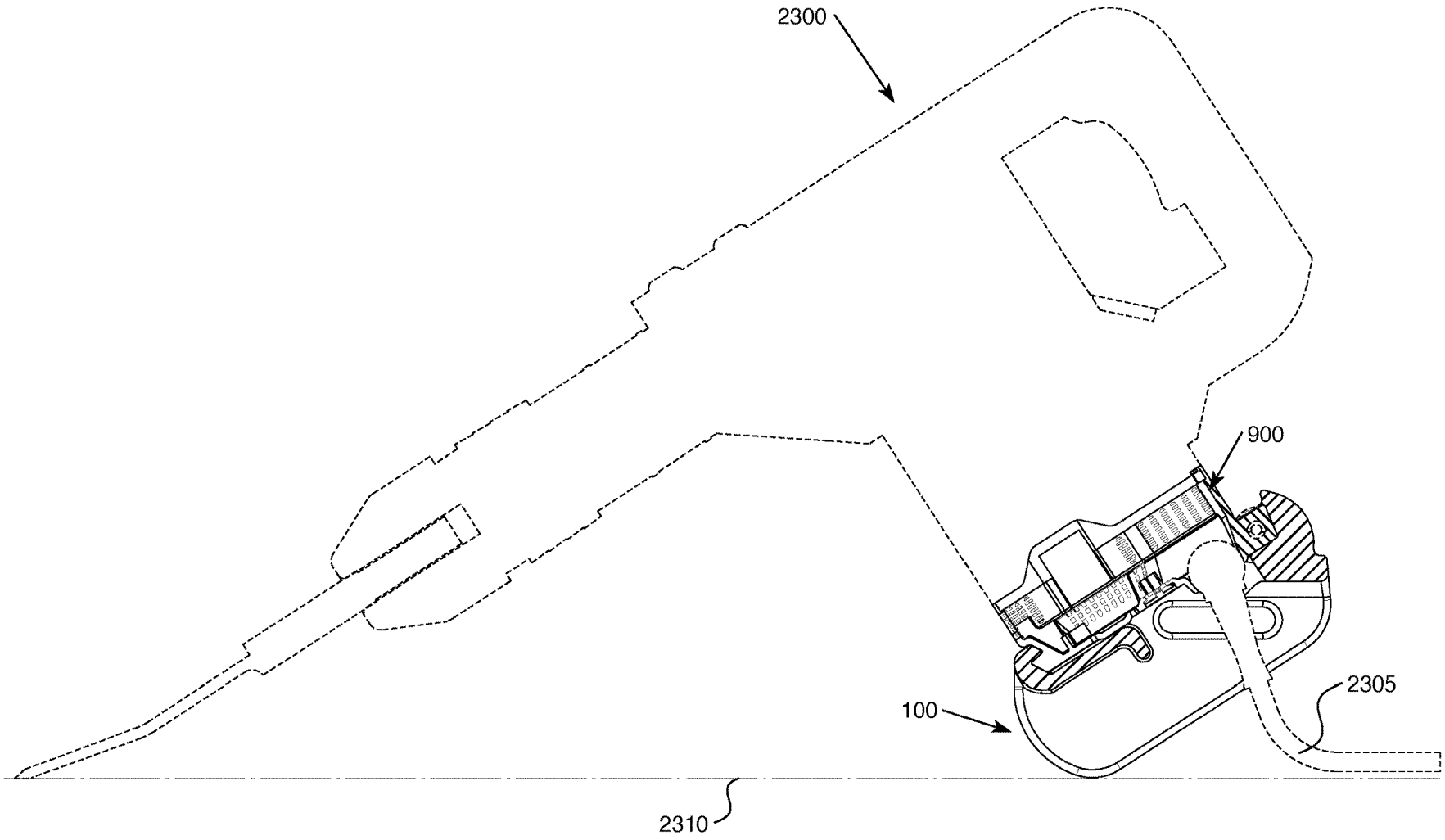
FIG. 23 depicts a side view of a ski attachment and a power tool base in use.
Figure 24:
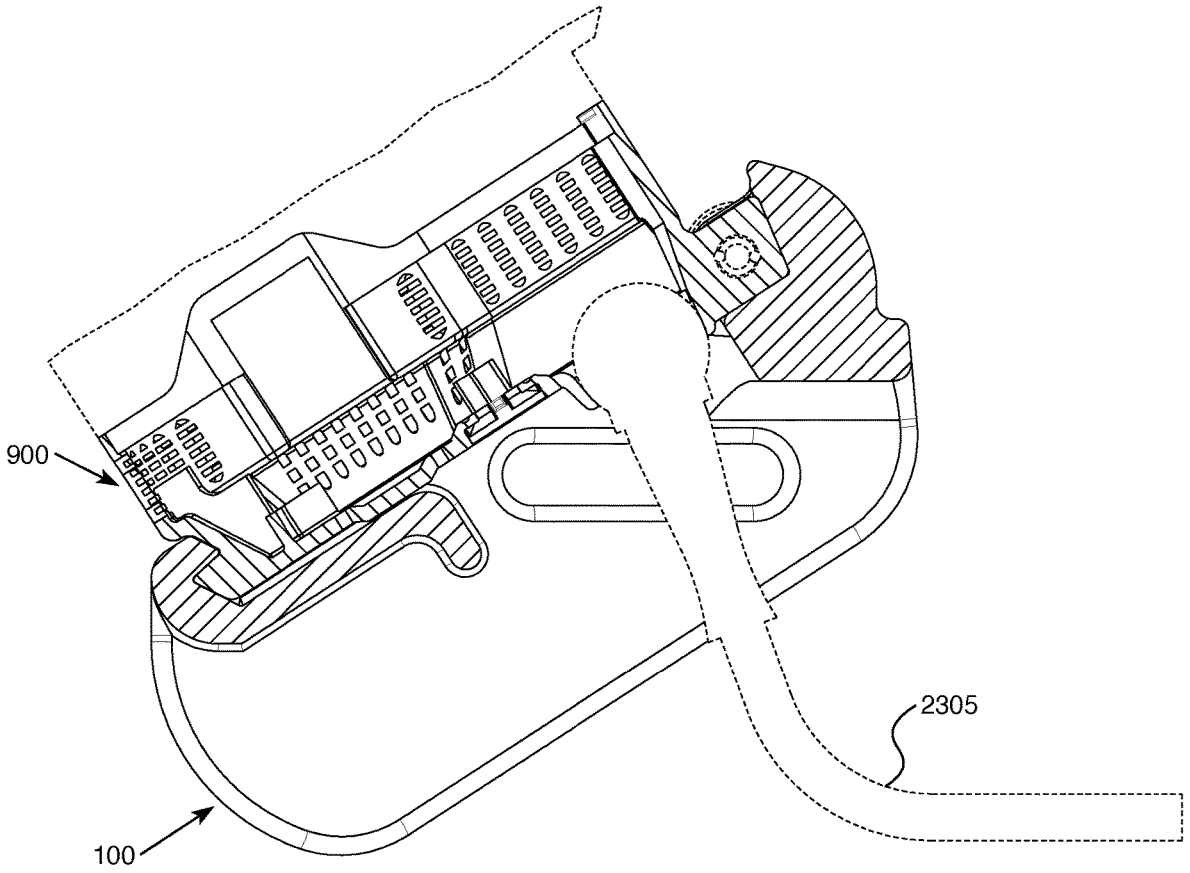
FIG. 24 depicts a close-up side view of a ski attachment and a power tool base in use.
Figure 25:
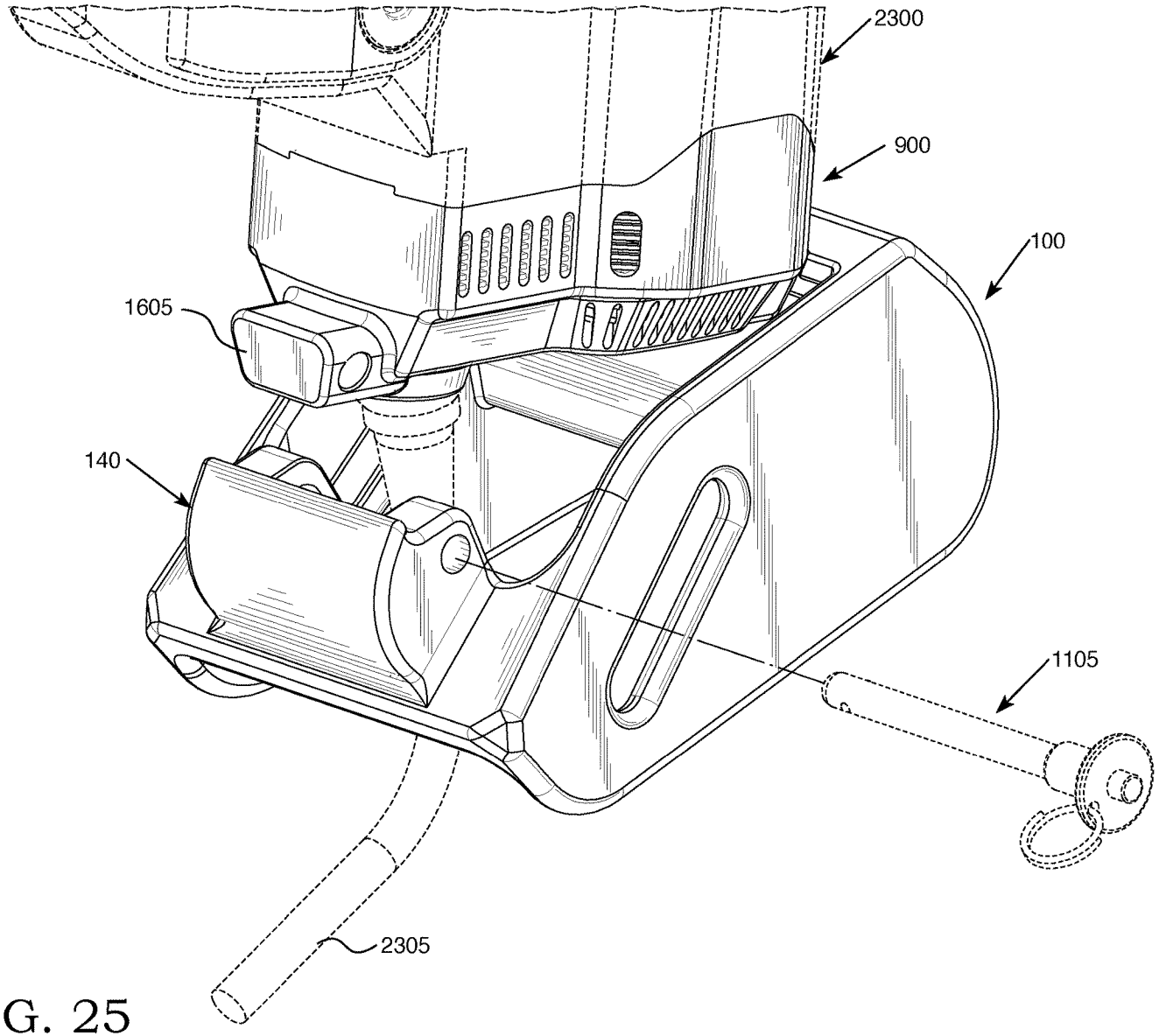
FIG. 25 depicts an oblique view of an implementation of a ski attachment and a power tool base, more specifically a securing mechanism in use.
Figure 26:
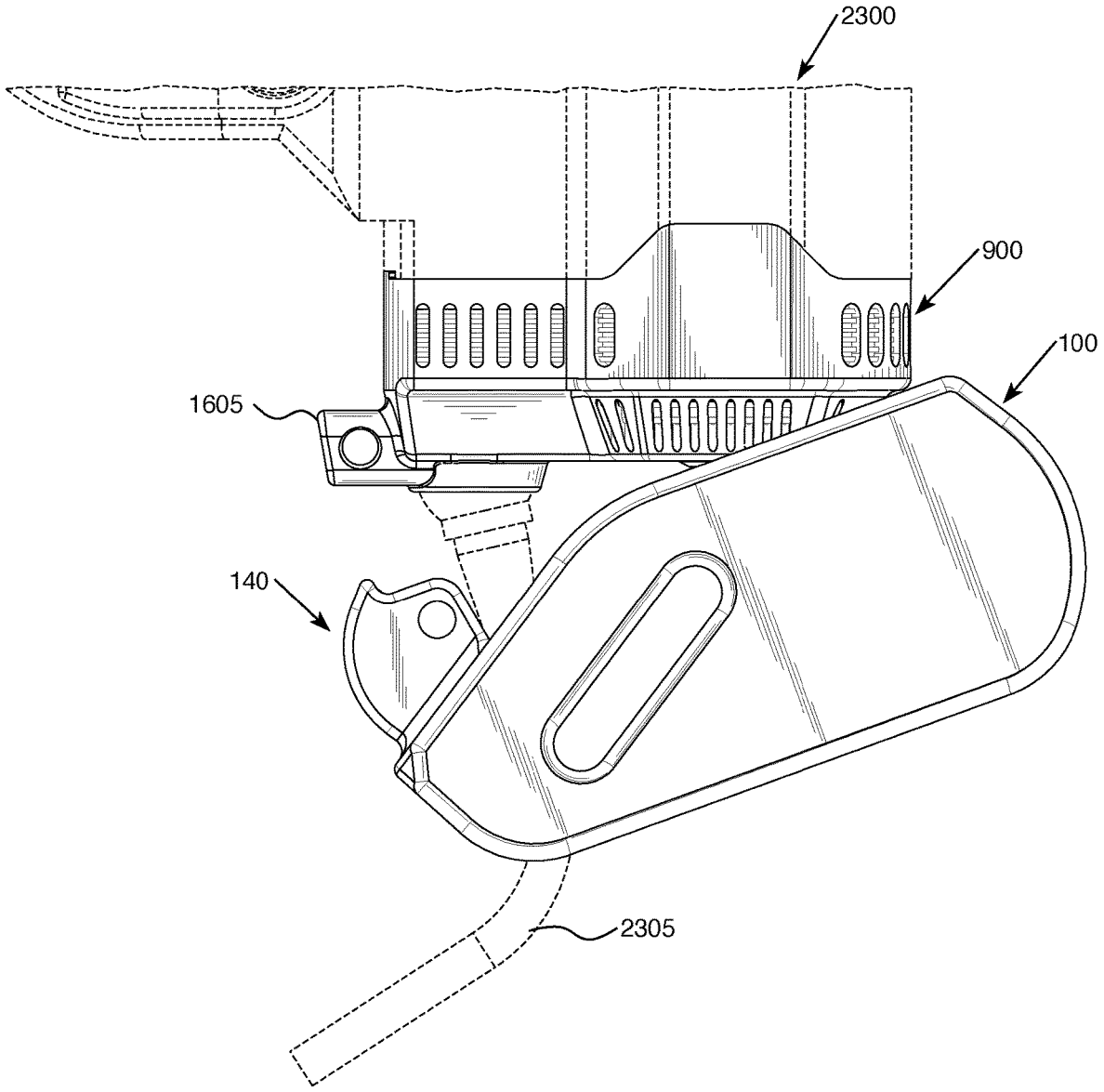
FIG. 26 depicts a side view of an implementation of a ski attachment and a power tool base, more specifically a securing mechanism in use.

FIG. 23 illustrates an exemplary demonstration of the power tool 2300 coupled to the base 900 and coupled to the ski 100. In this example, the power tool 2300 may be in use or at rest. In an exemplary embodiment, the power tool 2300 may be a chipping hammer. The chipping hammer can be used to break up tile, concrete, walls, flooring, ceiling, etc. The chipping hammer is heavy and can be burdensome to operate for extended periods of time. It can require a user to get low to the ground and bear the weight of the chipping hammer so as not to rest or drag the power cord 2305 along the work surface 2310. When coupled to the ski 100, this can be prevented. In one embodiment, the ski 100 can be rotated and articulated around the various edges. In the illustrated example, to place the power tool 2300 in the proper conformation to complete the task for which it is used, the ski 100 can be rotated onto the third side edge 520. For example, a chipping hammer may be coupled to the ski 100 and the whole system rotated such that the third side edge 520 is contacting the work surface 2310 and a chisel is in contact with the work surface 2310. In this conformation, the power tool 2300 is elevated from the work surface 2310 such that the power tool 2300 does not intake any dust, debris, or grit that is resting on the work surface 2310. The weight of the power tool 2300 is also not resting on the power cord 2310, but on the ski 100.

In some embodiments the ski 100 may be configured to allow the power cord 2301 to pass through the ski 100 to the opening 135. This may be accomplished by providing for the first side wall 105 or the second side wall 110 to be detachably coupled to the bridge 115. In some embodiments the first side wall 105, the second side wall 110, or the bridge 115 may further comprise a door. In another embodiment, the first side wall 105, the second side wall 110, or the bridge may further comprise a slit through which the power cord 2305 may enter into the opening 135. This provides convenience for threading the power cord 2305 through the ski 100, especially when the power cord 2305 is long.

Exemplary methods of use of the power tool include passing a power cord of a power tool through an opening of a ski, wherein the ski comprises a bridge, a first side wall coupled to a first edge of the bridge, and a second side wall coupled to a second edge of the bridge opposite the first edge of the bridge, wherein the bridge, the first side wall, and the second side wall form an opening configured to permit a power cord to pass therethrough; coupling a ski to a base of a power tool, wherein the bridge, the first side wall, and the second side wall comprise an upper surface configured to receive a base of a power tool; securing the ski to the base of the power tool via a securing mechanism coupled to the upper surface and configured to detachably couple to the base of a power tool; operating the power tool while the ski maintains contact with a surface, wherein the surface bears the power tool and the ski; and sliding the power tool and ski on the surface. In other embodiments coupling the ski to a base of a power tool further comprises inserting a notch under a lip of the ski, wherein the notch extends from the base and wherein the lip extends from the first side wall to the second side wall. The step of securing the ski to the base of the power tool may further comprise resting a knob, wherein the knob is coupled to the base, between a first block and a second block of the securing mechanism, such that a first channel of the first block, a third channel of the nob, and a second channel of the second block align; and inserting a securing pin into the first channel, the second channel, and the third channel.

I claim:

1. A power tool ski comprising:

a bridge;

a first side wall coupled, to a first edge of the bridge;

a second side wall coupled to a second edge of the bridge opposite the first, edge of the bridge;

wherein the bridge, the first side wall, and the second side wall comprise an upper surface configured to receive a base of a power tool;

wherein the bridge, the first side wall, and the second side wall form an opening configured to permit a power cord to pass therethrough; and wherein the first side wall and the second side wall are configured to elevate the base of the power tool from a work surface when coupled to the base of a power tool and configured to prevent contact between the base of the power tool and the work surface when coupled to, the base of the power tool; and a securing mechanism located distal from the upper surface and configured to detachably couple the power tool ski to the base of the power tool, the securing mechanism further comprising:

a first block;

a second block; and a receiving shelf coupling the first block to the second block.

2. The power tool ski of claim 1, wherein the first side wall and the second side wall are substantially parallel.

3. The power tool ski of claim 1, wherein the first side wall and the second side wall are non-parallel.

4. The power tool ski of claim 3, wherein a front edge of the bridge is narrower than a back edge of the bridge, such that the first side wall and a second side wall are non-parallel.

5. The power tool ski of claim 1, wherein the upper surface further comprises a lip configured to receive a notch of the base of the power tool, wherein the lip is located distal from the securing mechanism and extends from the first side wall to the second side wall.

6. The power tool ski of claim 1, wherein the securing mechanism comprises a channel configured to correspond to a second channel of a key and configured to receive a securing pin.

7. The power tool ski of claim 1, wherein the first side wall and the second side wall each comprise:

a first side edge;

a second side edge substantially parallel to the first side edge;

a third side edge extending from the first side edge to the second side edge, wherein the third side edge is substantially arc-shaped;

a fourth side edge extending from the first side edge opposite the third side edge and forming an obtuse angle relative to the first side edge; and a fifth side edge extending from the second side edge opposite the third side edge and forming an obtuse angle relative to the second side edge and forming a substantially right angle relative to the fourth side edge.

8. The power tool ski of claim 7, wherein the first side edge, the second side edge, the third side edge, the fourth side edge, and the fifth side edge are rounded.

9. The power tool ski of claim 7, wherein a length of the ski is approximately 6⅜".

10. The power tool ski of claim 9, wherein a width of the ski is approximately 4½".

11. The power tool ski of claim 7, wherein, the third side edge is configured to allow the power tool to be placed on a surface and prevent kinking the power cord.

12. The power tool ski of claim 7, wherein the power tool is a chipping hammer.

13. The power tool ski of claim 12, wherein the third side edge is configured to allow the chipping hammer to rest on a work surface and a chisel of the chipping hammer to maintain contact with the work surface.

14. The power tool ski of claim 1, wherein the first side wall is detachably coupled to the bridge.

15. A power tool ski system comprising:

a base configured to couple to a power tool, comprising:

a side wall configured to conform to the base of the power tool; and an end wall coupled to the side wall; and a ski comprising:

a bridge;

a first side wall coupled to a first edge of the bridge; and a second side wall coupled to a second edge of the bridge opposite the first edge of the bridge;

wherein the bridge, the first side wall, and the second side wall comprise an upper surface configured to receive a base of a power tool;

wherein the bridge, the first side wall, and the second side wall form an opening configured to permit a power cord to pass therethrough; and wherein the first side wall and the second side wall are configured to elevate the power tool when located on a surface such the power cord is unkinked; and a securing mechanism located distal from the upper surface and configured to detachably couple the power tool ski to the base of the power tool, the securing mechanism further comprising:

a first block;

a second block; and a receiving shelf coupling the first block to the second block.

16. The power tool ski system of claim 15, wherein the base further comprises a notch.

17. The power tool ski system of claim 16, wherein the notch is configured to detachably couple to the securing mechanism.

18. A method of preventing uptake of grit in power tools, comprising:

passing a power cord of a power tool through an opening of a ski, wherein the ski comprises a bridge, a first side wall coupled to a first edge of the bridge, and a second side wall coupled to a second edge of the bridge opposite the first edge of the bridge, wherein the bridge, the first side wall, and the second side wall form an opening configured to permit a power cord to pass therethrough;

coupling a ski to a base of a power tool, wherein the bridge, the first side wall, and the second side wall comprise an upper surface configured to receive a base of a power tool;

securing the ski to the base of the power tool via a securing mechanism located distal from the upper surface and configured to detachably couple the power tool ski to the base of the power tool, the securing mechanism further comprising:

a first block;

a second block; and a receiving shelf coupling the first block to the second block; and operating the power tool while the ski maintains contact with a work surface, wherein the work surface bears the power tool and the ski; and sliding the power tool and ski on the work surface.

19. The method of claim 18, wherein coupling the ski to a base of a power tool further comprises inserting a notch under a lip of the ski, wherein the notch, extends from the base and wherein the lip extends from the first side wall to the second side wall.

20. The method of claim 18, wherein securing the ski to the base of the power tool further comprises:

resting a knob, wherein the knob is coupled to the base, between the first block and the second block of the securing mechanism such that a first channel of the first block, a third channel of the nob, and a second channel of the second block align; and inserting a securing pin into the first channel, the second channel, and the third channel.

* * * * *